US006064847A

United States Patent [19]

Iwamatsu et al.

[11] Patent Number: 6,064,847

[45] Date of Patent: May 16, 2000

[54] DEVELOPING DEVICE

[75] Inventors: Tadashi Iwamatsu, Nara; Nobuyuki Azuma, Ibaraki, both of Japan

[73] Assignee: Sharp Kabushiki Kaisha, Osaka, Japan

[21] Appl. No.: 09/328,240

[22] Filed: Jun. 8, 1999

[30] Foreign Application Priority Data

Jun. 22, 1999 [JP] Japan ..... 10-174260

[51] Int. Cl.[7] ..... G03G 15/08

[52] U.S. Cl. ..... 399/283; 399/281; 399/285

[58] Field of Search ..... 399/27, 280, 281, 399/283, 284, 285, 286, 279, 265, 252; 430/111, 107, 105, 120

[56] References Cited

U.S. PATENT DOCUMENTS 5,367,367 11/1994 Ikeda et al. ..... 399/281
5,477,006 12/1995 Imamiya et al. ..... 399/285

FOREIGN PATENT DOCUMENTS 3-041486 2/1991 Japan .

OTHER PUBLICATIONS

U.S. Patent application Ser. No. 09/256,616; filed Feb. 23, 1999, pending.
U.S. Patent application Ser. No. 09/239,122; filed Jan. 28, 1999, pending.
U.S. Patent application Ser. No. 09/244,582; filed Feb. 4, 1999, pending.

*Primary Examiner*—Sophia S. Chen
*Attorney, Agent, or Firm*—Renner, Otto Boisselle & Sklar

[57] ABSTRACT

A developing device for developing an electrostatic latent image on a photoconductive member has a developing roller that bears a one-component developer on its surface and develops the electrostatic latent image by contacting the photoconductive member; a supply roller for supplying developer to the developing roller; and a blade that contacts the developing roller so as to regulate a layer thickness of the developer supplied by the supply roller, wherein supposing that the developer has a volume-average particle size represented by Dbk, the developer at this time being maintained on the developing roller as a layer that has been supplied by the supply roller and again formed so as to have a predetermined thickness by the blade after the developing roller, on which the developer was formed as a layer having a predetermined thickness, carried out a black-image developing process, and supposing that the volume-average particle size of the developer is Dwt, the developer at this time being maintained on the developing roller as a layer that has been supplied by the supply roller and again formed so as to have a predetermined thickness by the blade after the developing roller, on which the developer was formed as a layer having a predetermined thickness, carried out a white-image developing process, an inequality, Dwt/Dbk>0.8, is satisfied.

23 Claims, 15 Drawing Sheets

DEVELOPING DEVICE

FIELD OF THE INVENTION

The present invention relates to a developing device of a one-component developing system, which is provided in an image-forming apparatus of the electrophotographing system such as a copying machine, a printer, etc., so as to develop an electrostatic latent image formed on the surface of a photoconductive member.

BACKGROUND OF THE INVENTION

An image-forming apparatus such as a copying machine and a printer which uses an electrophotographic system is provided with a developing device for developing an electrostatic latent image formed on the surface of a photoconductive member.

In recent years, in response to demands for miniaturization of image-forming apparatuses, there have been ever-increasing demands for miniaturization of developing devices, with the result that techniques for ensuring the developing characteristics as well as for achieving miniaturization has been demanded.

For example, a developing device has been put into practical use in which a developing roller using the magnetic brush system, which carries a two-component developer consisting of toner and magnetic carrier to a developing area facing a photoconductive member by utilizing a magnetic force, is provided, and after completion of the developing process, the developer is recovered into a developing vessel.

In the above-mentioned magnetic brush system, in order to stabilize the developing process, it is necessary to supply toner to be consumed and also to control the ratio of the toner contained in the developer, that is, the toner density, to be constant.

Normally, in the developing device using the above-mentioned magnetic brush developing system, the carrier accounts for a greater ratio in the developer, making it necessary to increase the size of the developer vessel storing the developer; this tends to make an entire developing device larger. Moreover, stirring members, etc., are required so as to control the toner density and to make constant the quantity of charge in the toner in the developer, and this plurality of stirring members are one of the reasons that miniaturization of the developing device has been limited.

Recently, in order to avoid the above problem, a developing device of one-component developer system, which uses a one-component developer consisting of toner without containing a carrier, has been proposed and put into practical use. In the developing device using such a one-component developer, it is neither necessary to control the toner density, nor to provide a carrier, so that the volume of the developing vessel can be greatly reduced, thereby making it possible to miniaturize the developing device.

Moreover, this one-component developer system is superior in ease of maintenance, etc. In other words, since no exchange for deteriorated developer, especially for developer containing deteriorated carrier, is required, no corresponding maintenance is required.

Furthermore, since it is only necessary to replenish toner, and since neither detection of the toner density nor control for the detection is required, this system makes it possible to simplify the controlling process. In other words, the developing device using one-component toner only requires refilling of toner on demand.

In the developing device having the above-mentioned arrangement, predetermined voltages are applied to respective members constituting the developing device, such as the developing roller and supplying roller, in order to develop an electrostatic latent image formed on the photoconductive member with high fidelity.

Therefore, electrical characteristics of toner and the respective members form major factors in determining the developing characteristic. In particular, the quantity of charge in toner and the resistivity of the developing roller greatly affect the developing characteristic.

The relationship between the specific charge q/m (quantity of charge per unit mass) and the developing characteristic is indicated by a characteristic shown in FIG. 10, wherein, when the specific charge is small, the electric potential difference from the developing start voltage to the developing end voltage is small. Hereinafter, this characteristic is referred to as "a rising developing gamma characteristic". In contrast, when the specific charge is large, the electric potential difference from the developing start voltage to the developing end voltage is large. Hereinafter, this characteristic is referred to as "a flat developing gamma characteristic". Therefore, if a developing device has great fluctuations in the toner specific charge, it has great fluctuations in the developing characteristics, failing to form good images. Since conventional one-component developing devices fail to sufficiently suppress the fluctuations in the specific charge, they tend to have degradation in the image quality, for example, the occurrence of developing ghost images.

Moreover, the relationship between the developing roller resistivity and the developing characteristics is indicated by a characteristic shown in FIG. 8, wherein the greater the resistivity, the more flat developing gamma characteristic is exerted. For example, in the case of application of a developing roller having a high resistivity which has been conventionally proposed, since the developing roller is highly susceptible to resistivity fluctuations under the influence of temperatures and humidities, the developing characteristics change greatly, resulting in a problem of, for example, great fluctuations in the image density. Moreover, this also causes degradation in the image quality, such as the occurrence of developing ghost images, due to a charge accumulated on the surface of the highly resistive layer of the developing roller.

Therefore, in the developing device using a one-component developer, it has been proposed that the toner charging characteristic be stabilized by using a charge-control agent and an externally added agent and that the developing characteristic be stabilized by allowing the developing roller to have a low resistivity; however, these efforts have not sufficiently achieved high image-quality yet.

More specifically, with respect to the specific charge fluctuations in the one-component developer, the developer inherently contains specific charge fluctuations due to the distribution of toner particle sizes, that is, the specific charge fluctuates simultaneously with particle size fluctuations.

Moreover, with respect to the developing roller resistivity, the application of a highly resistive developing roller tends to cause a problem of the occurrence of developing ghost images due to a charge accumulated on the surface of the highly resistive layer; in contrast, the application of a low resistive developing roller tends to cause a problem of degradation in the image quality due to dielectric breakdown in the toner layer and over-currents.

SUMMARY OF THE INVENTION

The objective of the present invention is to provide a developing device of the one-component developing system which can stabilize the developing characteristics and achieve a superior developing operation by preventing degradation in the image quality due to dielectric breakdown in the toner layer as well as developing ghost images caused by particle-size fluctuations in the developer.

In order to achieve the above-mentioned objective, the developing device of the present invention, which develops an electrostatic latent image on the electrostatic-latent image bearing body, is provided with a developer-bearing body which bears one-component developer on its surface and develops the electrostatic latent image by contacting an electrostatic-latent-image bearing body, a developer-supplying member for supplying developer to the developer-bearing body, and a developer-layer regulating member which contacts the developer-bearing body so as to regulate the layer thickness of the developer that has been supplied by the developer-supplying member, and supposing that the volume-average particle size of the developer is Dbk, the developer at this time being maintained on the developer-bearing body as a layer that has been supplied by the developer-supplying member and again formed so as to have a predetermined thickness by the developer-layer regulating member after the developer-bearing body, on which the developer was formed as a layer having a predetermined thickness, carried out a colored-image developing process, and supposing that the volume-average particle size of the developer is Dwt, the developer at this time being maintained on the developer-bearing body as a layer that has been supplied by the developer-supplying member and again formed so as to have a predetermined thickness by the developer-layer regulating member after the developer-bearing body, on which the developer was formed as a layer having a predetermined thickness, carried out a non-color-image developing process, an inequality, Dwt/Dbk>0.8, is satisfied.

In the above-mentioned arrangement, by controlling and limiting the difference between the volume-average particle size Dwt of the developer at a non-color image developing portion and the volume-average particle size Dbt of a colored-image developing portion to the range indicated by the above-mentioned inequality, it is possible to maintain the change in the average quantity of specific charge that depends on image patterns within a predetermined value range; therefore, it becomes possible to prevent the generation of developing image ghosts, and consequently to provide a developing device which can carry out a desired developing process.

For a fuller understanding of the nature and advantages of the invention, reference should be made to the ensuing detailed description taken in conjunction with the accompanying drawings.

BRIEF DESCRIPTION OF THE DRAWINGS

FIG. 7(*b*) is a side view of the measuring device shown in FIG. 7(*a*).

DESCRIPTION OF THE EMBODIMENTS

Referring to Figures, the following description will discuss one embodiment of the present invention.

Figure 1:
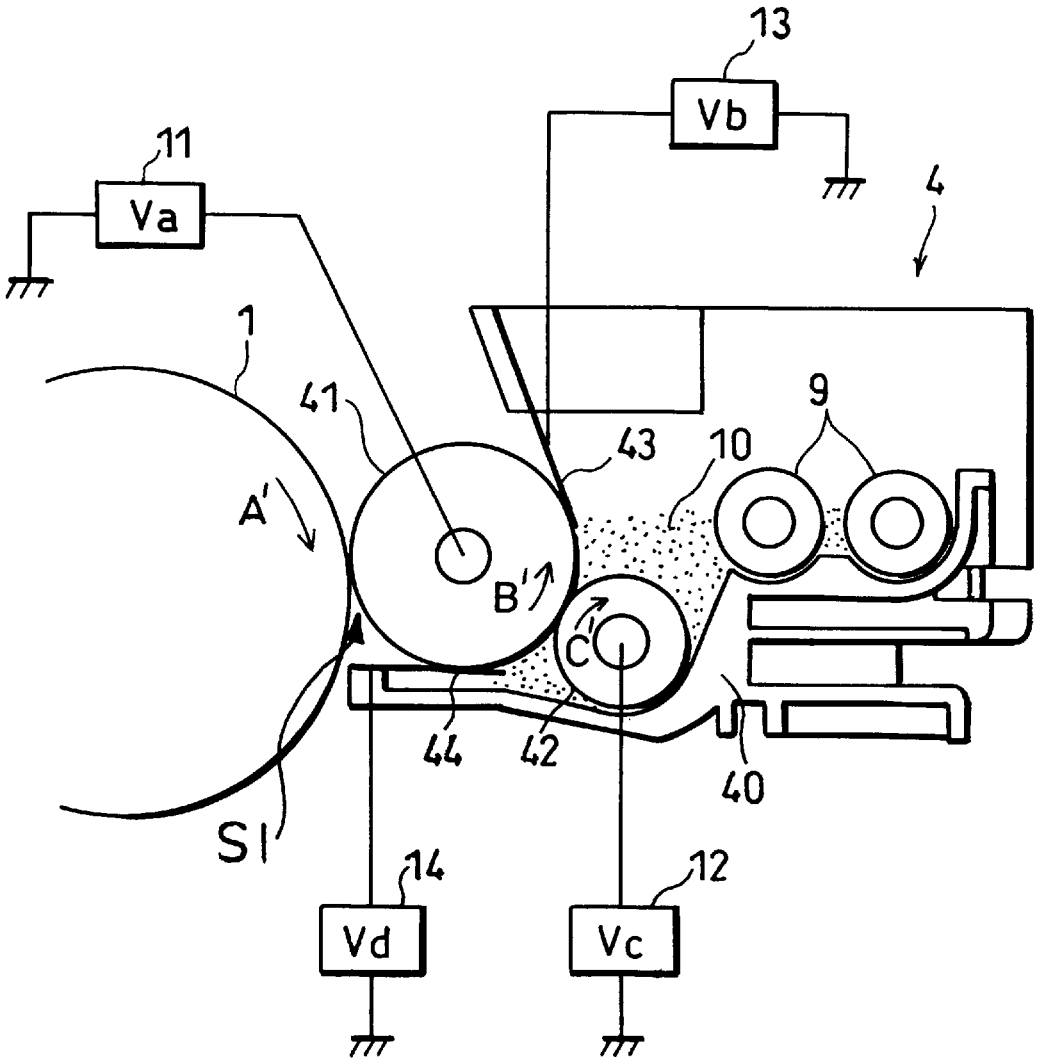
FIG. 1 is a schematic side view that shows the structure of a developing device in accordance with the present invention, which contacts a photoconductive member bearing an electrostatic latent image and carries out a developing process by using a one-component developer.

FIG. 1 is a schematic side view showing a developing device 4, which is aligned face to face mainly with a photoconductive member 1 (an electrostatic-latent-image bearing body) in an image-forming apparatus of the present embodiment. Further, FIG. 4 is a side view showing an essential portion of the structure of the image-forming apparatus provided with the developing device 4 of FIG. 1.

Figure 4:
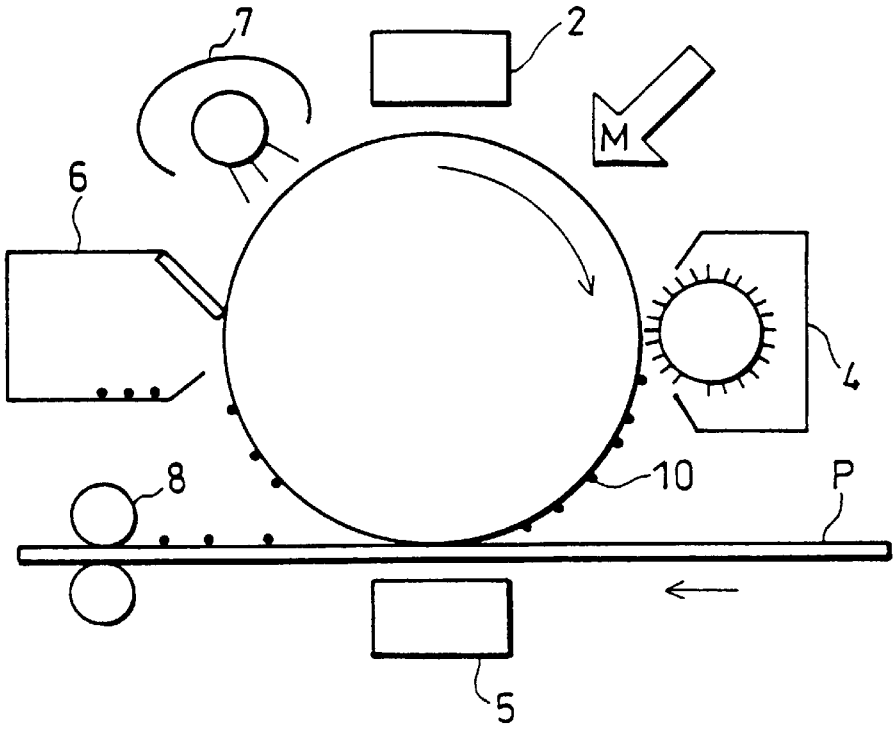
FIG. 4 is a schematic side view that shows the entire structure of an image-forming apparatus in which the developing device shown in FIG. 1 is installed.

First, referring to FIG. 4, an explanation will be schematically given of a construction of the image-forming apparatus. The present image-forming apparatus is constituted by a photoconductive member 1 and various image-forming process devices that are disposed in a manner so as to face the photoconductive member 1 on the periphery thereof. The photoconductive member 1, which is placed virtually in the center of the image-forming apparatus main body and which is a drum-shaped image-bearing body for bearing an electrostatic latent image, is driven to rotate at a constant velocity in the direction of arrow A' at the time of an image-forming operation.

The above-mentioned image-forming process devices include a charger 2 for uniformly charging the surface of the photoconductive member 1, an optical system (not shown) for irradiating an image M with light in accordance with a picture image, a developing device 4 related to the present invention which visualizes an electrostatic latent image that has been formed on the surface of the photoconductive member 1 by exposure with the optical system, a transferring device 5 for transferring a developed toner image (image of one-component developer 10) onto a sheet of paper P that has been appropriately transported, a cleaning device 6 for removing residual developer (toner) that has not been transferred onto the surface of the photoconductive member 1 after the transferring operation, a static-eliminating device 7 for eliminating an electrostatic charge remaining on the surface of the photoconductive member 1, etc., and these devices are arranged in this order in the rotation direction of the photoconductive member 1.

A number of sheets of paper P are housed in, for example, a tray or a cassette, and the sheets of paper housed therein are fed by a feeding means (not shown) sheet by sheet, and transported to a transferring area facing the photoconductive member 1, in which the above-mentioned transferring device 5 is placed, in a manner so as to coincide with the leading edge of a toner image formed on the surface of the photoconductive member 1. After this transferring operation, the paper P is separated from the photoconductive member 1, and transported to the fixing device 8.

The fixing device 8, which fixes the unfixed toner image transferred onto the paper as a permanent image, is constituted by a heat roller having a surface facing the toner image, with the surface being heated to a temperature at which the toner is fused and fixed, a pressure roller which allows the paper P pressed toward the heat roller to closely contact the heat roller, and other members. The paper P, which has passed through the fixing device 8, is ejected from the image-forming apparatus onto a discharge tray (not shown) through discharging rollers (not shown).

In the case when the image-forming apparatus is provided as a copying machine, the optical system, not shown, irradiates a copy document with light, and the reflected light from the document is projected as a light image M. Moreover, in the case when the image-forming apparatus is provided as a printer or a digital copying machine, the optical system projects a light image M obtained by ON/OFF driving a semiconductor laser in accordance with image data. In particular, in the digital copying machine, the image data, obtained by reading the reflected light from the copy document with an image reading sensor (CCD elements, etc.), is inputted to the optical system including the semiconductor laser from which a light image M in accordance with the image data is outputted. Moreover, in the printer, conversion is made in accordance with image data from another processing apparatus, such as a word processor and a personal computer, so as to form a light image M, and this is projected. This conversion to the light image M is carried out by utilizing not only a semiconductor laser, but also an LED (Light Emitting Diode) element, a liquid crystal shutter, etc.

When an image-forming operation is started in the image-forming apparatus described above, the photoconductive member 1 is driven to rotate in the arrow direction, and the surface of the photoconductive member 1 is uniformly charged by the charger 2 to an electric potential having a specific polarity. After this charging process, a light image 3 is projected thereto from the optical system, not shown, so that an electrostatic latent image in accordance with the light image is formed on the surface of the photoconductive member 1. This electrostatic latent image is developed and visualized by the succeeding developing device 4. In the present invention, this developing process is carried out by using one-component developer in such a manner that the toner is selectively attracted to the electrostatic latent image formed on the surface of the photoconductive member 1, for example, by an electrostatic force; thus, a developing operation is carried out.

The toner image, thus developed on the surface of the photoconductive member 1, is electrostatically transferred onto a sheet of paper P, which has been appropriately transported in synchronism with the rotation of the photoconductive member 1, by the transferring device 5 disposed at the transferring area. In this transferring process, the toner image is transferred toward the paper P side by allowing the transferring device 5 to charge the back surface of the paper P with a polarity reversed to the polarity of charged toner.

After the transferring operation, a portion of the toner image, which has not been transferred, remains on the surface of the photoconductive member 1, and the residual toner is removed from the surface of the photoconductive member 1 by the cleaning device 6, and in order to use the photoconductive member 1 again, the surface of the photoconductive member 1 is static eliminated to a uniform electric potential, for example, virtually 0 electric potential, by the static-eliminating device 7.

Meanwhile, after the transferring operation, the paper P is separated from the photoconductive member 1, and transported to the fixing device 8. In the fixing device 8, the toner image on the paper P is fused, pressed onto the paper P by a pressing force between rollers, and fixed thereon. The paper, which has passed through the fixing device 8, is ejected onto the discharge tray (not shown), etc., installed outside of the image-forming apparatus as a sheet of paper P which has been subjected to the image-forming operation.

Next, referring to FIG. 1, an explanation will be given of the structure of a developing device of the present embodiment which carries out a developing process using a one-component developer 10. The developing device 4 includes a developer vessel 40, and is provided with a developing roller 41 (developer-bearing body) installed so as to freely rotate, a supply roller 42 (developer supplying member), an agitator or a screw roller 9, etc. One-component developer 10, for example, non-magnetic one-component developer (toner), is housed in the developing device 4, and the one-component developer 10 is supplied toward the developer roller 41 by the supply roller 42. The agitator or a screw roller 9 is installed on the right side of the developer vessel 40 in FIG. 1 (on the side of the supply roller 42 opposite to the developing roller 41), and sends the one-component developer 10 supplied on demand into the developer vessel 40.

The developing roller 41, installed inside the developer vessel 40, rotates in the direction of arrow B' in order to transport toner to a developing area at which one portion thereof is exposed so as to face the photoconductive member 1, and is allowed to rotate in the same direction as the photoconductive member 1 at the developing area. The above-mentioned supply roller 42 is pressed onto the developing roller 41.

The developing roller 41 has a construction in which, for example, the surface of a metal roller (including a rotary shaft 41*a*) is coated with a high polymer elastic member. With respect to the high polymer elastic member, polyurethane, etc., in which carbon is dispersed, or an ion-conductive solid rubber, etc., is adopted; thus, it is possible to maintain a predetermined resistivity at which no toner fusion, etc., occurs, and consequently to provide an effective supply of a developing bias voltage, as will be described later. Additionally, a specific example will be given later of the construction of the developing roller 41 used in the present invention.

A driving motor, not shown, is connected to the developing roller 41, and the developing roller 41 is driven to rotate in the arrow direction in the Figure. The one-component non-magnetic toner 10 is attracted onto the surface of the developing roller 41 being rotated, and transported to the developing area facing the surface of the photoconductive member 1. Here, since the developing roller 41 is pressed onto the surface of the photoconductive member 1, the press-contact area forms the developing area so that one-component developer 10 is attracted to the electrostatic latent image on the surface of the photoconductive member 1, thereby allowing the image to be developed. The developing area at which the developing roller 41 and the photoconductive member 1 come into contact with each other, that is, a contact area, is set to have a desired contact area S1 ($cm^2$). A detailed description will be given of the contact area S1 later.

The above-mentioned one-component developer 10 is a one-component non-magnetic toner having, for example, an average particle size of approximately 10 $\mu$m, and polyester toners or styrene-acrylic toners may be adopted.

A developing bias voltage Va is supplied from a developing bias power-supply circuit 11 to the developing roller 41. The developing bias voltage Va is properly set at a voltage value with a polarity so as to allow toner to adhere to the electrostatic latent image formed on the photoconductive member 1 and also so as not to allow toner to adhere to the other area, that is, a non-image area.

With respect to the rotation direction of the supply roller 42, it is driven to rotate in a direction reversed to the rotation direction of the developing roller 41 (in the direction of arrow C' in the Figure) at an opposing portion (press-contact area) to the developing roller 41. The supply roller 42 is made of a material similar to that of the developing roller 41, and the adjustment of the electric resistance thereof can be made by using a resistance-adjusting material similar to that of the developing roller 41. Moreover, in order to further increase the elasticity of the supply roller 42, a foamed (porous) material may be adopted.

A bias voltage Vc is applied to the supply roller 42 from a bias power-supply circuit 12, and in general, the bias voltage is set so as to press toner toward the developing roller 41, that is, so as to repel toner on the supply roller 42 side and supply it to the developing roller 41. For example, in the case of the application of a toner with a negative polarity, a bias voltage Vc that is greater in the negative polarity side than the bias voltage Va applied to the developing roller 41 is applied to the supply roller 42.

The developing roller 41 and the supply roller 42 are connected to a driving motor, not shown, and rotated in the directions of arrows in the Figure so that toner is supplied to the developing roller 41, while residual toner on the surface of the developing roller 41 which has not been used is separated (removed) therefrom after the developing operation, by the supply roller 42. The toner, supplied by the supply roller 42, is allowed to adhere to the surface of the developing roller 41, and before it is transported to the developing area facing the surface of the photoconductive member 1, it is regulated to a predetermined toner-layer thickness by a blade 43 (developer-layer regulating member) that is appropriately pressed onto the developing roller 41 so as to regulate the amount of toner adhesion to the developing roller 41.

The blade 43 is pressed onto the developing roller 41 with an appropriate pressure. The blade 43 is constituted by blade forming members made of plate-shaped metal members, and its thick portion (face) in the vicinity of the tip is pressed onto the developing roller 41. Therefore, the one component developer 10 (toner), supplied to the developing roller 41, is regulated to a predetermined thickness with a predetermined quantity of static charge by the predetermined setting pressure and setting position of the blade 43, and transported to the developing area which faces and contacts the photoconductive member 1.

The blade 43 serving as a developer-layer regulating member has its one end secured to the developer vessel 40 side, with the other free end being pressed onto the surface of the developing roller 41 at the thick portion. The regulating member 43, which is made of a metal plate, such as phosphor bronze or stainless steel (SUS), with a plate thickness of, for example, approximately 0.1 to 0.2 mm, is pressed onto the developing roller 41 with a predetermined pressure in the length direction (in the direction of the rotary shaft of the developing roller) at its thick portion in the vicinity of the tip thereof. Thus, the amount of the one-component developer 10 that has been supplied by the supply roller 42 and supported on the surface of the developing roller 41 is made constant by the regulating member 43, and transported to the developing area that contacts the photoconductive member 1.

A predetermined voltage Vb is supplied to the blade 43 from the bias power-supply circuit 13. This bias voltage Vb is set so that, for example, in the case of a toner with a negative polarity, it has a greater value in the negative polarity side than the bias voltage Va applied to the developing roller 41 so as to press the toner toward the developing roller 41. Moreover, in some cases, the bias voltage Vb to be supplied to the blade 43 is set at the same electric potential as the developing bias voltage Va to be supplied to the developing roller 41, or at a value greater than that in absolute value.

The one-component developer 10 (toner), which has been transported to the developing area facing the photoconductive member 1, is allowed to selectively adhere to the surface of the photoconductive member 1 in accordance with an electrostatic latent image formed thereon so that the electrostatic latent image is visualized by the color of the toner. Then, the toner 10 that has not been used in the developing process is returned into the developer vessel 40 by the rotation of the developing roller 41. At the position related to the recovery, a toner reset member 44 for removing toner is installed in a manner so as to be pressed onto the developing roller 41. This reset member 44 is placed before the supply roller 42 in the rotation direction of the developing roller 41 so that one end is secured to the developer vessel 40 so as to maintain an appropriate contact with the developing roller 41, with the other end being pressed onto the developing roller 41 by utilizing a spring property exerted by an area for allowing its thick portion on the other free end side to be pressed thereon.

After a developing process, the toner that has not been used in the developing process is static-eliminated and removed by the reset member 44 while being recovered into the developer vessel 40 by the rotation of the developing roller 41, and reused. A bias voltage Vd for eliminating and removing a static charge from the toner, is supplied to the reset member 44 from the power-supply circuit 14.

As described above, the developing device 4 transports the one-component developer 10 (toner) to the area facing the photoconductive member 1, and visualizes an electrostatic latent image on the surface of the photoconductive member 1, thereby forming a toner image. The toner image on the surface of the photoconductive member 1 is transferred by the function of the transferring device 5 onto paper P that has been appropriately transported to the transferring area, as described earlier, and after having passed through the fixing device 8, ejected out of the image-forming apparatus.

With respect to the photoconductive member 1, an OPC (Optical Photo-Coupler) photoconductive member, etc., is used in which the surface of a conductive base made of metal or resin is coated with an under layer, a carrier generator layer (CGL) as the upper layer, and a carrier transport layer (CTL) having polycarbonate as its main ingredient as the outermost layer. In the present invention, the photoconductive member is not limited thereby, and any bearing body for bearing an electrostatic latent image may be used.

[Structure of the developing roller]

With respect to the developing roller 41 as described above, the following description will further discuss the structure thereof in more detail.

Figure 5:
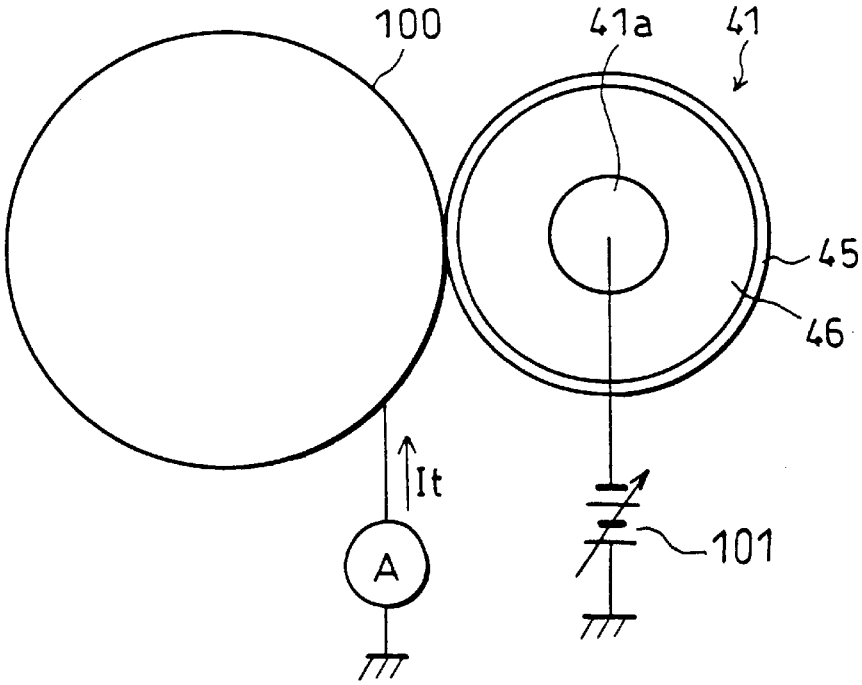
FIG. 5 is an explanatory drawing that shows a specific example of a device for measuring the still resistivity of a toner in a thin-layer state that is used in the developing device of the present invention.

As illustrated in FIG. 5, for example, the developing roller 41 is constituted by a rotary shaft 41*a* (conductive shaft) made of a core member of metal or low-resistance resin, and a semiconductive layer 46 coated thereon which is an elastic member having, for example, a relative dielectric constant of approximately 10. A toner layer 45 is formed on the surface of this semiconductive layer 46.

With respect to the elastic member on the surface of the developing roller 41, those elastic members obtained as follows are preferably used: one containing as a base material a dispersion-type resistance adjusting resin which is obtained by mixing and dispersing either one or a plurality of conductive fine particles, such as carbon and $TiO_2$ (titanium oxide), to a resin selected from the group consisting of Ethylene Propylene Diene Terpolymer (EPDM), urethane, silicone, nitrile-butadiene rubber, chloroprene rubber, styrene-butadiene rubber and butadiene rubber; and one containing as a base material an electrical resistance adjusting resin which is obtained by adding to the above-mentioned resin either one or a plurality of ion conductive materials, for example, inorganic ion conductive substances, such as sodium perchloric acid, calcium perchloric acid and sodium chloride. Moreover, in the case when a foaming agent is used in a forming/mixing process for obtaining elasticity, a silicon-type surface active agent (block copolymer of polysiloxane-polyalkylenoxide) is preferably used.

In an example of a heat-blow forming that is one of the methods for the above-mentioned foaming, appropriate amounts of the above-mentioned materials are blended and stirred in a mixing injection device, and this is injected into an injection extruding mold and heated at 80° C. to 120° C., and thus injection-molded. The heating time is preferably set at approximately 5 to 100 minutes.

In the case when the core member is integrally molded by injection molding, a conductive metal core member (shaft) is placed in the center of a mold which has been preliminarily prepared, and the mixture is poured in the same manner as described above, and heated and cured for approximately 10 to 160 minutes; thus, an integrally molded product is obtained.

With respect to the carbon black that is one of electric-resistance adjusting materials for the developing roller 41, a carbon black (for example Intermediate Super Abrasion Furnace (ISAF), High Abrasion Furnace (HAF), General Purpose Furnace (GPF), Semi Reinforcing Furnace (SRF), etc.), which has a nitrogen-adsorption specific surface area of not less than 20 $m^2/g$ to not more than 130 $m^2/g$ and an amount of oil absorption (Dibutyl Phthalate (DBP)) of not less than 60 ml/g to not more than 120 ml/g is used, and 0.5 to 15 parts by weight (in some cases, at approximately 70 parts by weight) of this is blended to 100 parts by weight of polyurethane.

With respect to the above-mentioned polyurethane, soft polyurethane foam and polyurethane elastomers are preferably used. Besides these, the above-mentioned EPDM, urethane, silicone, nitrile-butadiene rubber, chloroprene rubber, butadiene rubber, etc., may be adopted.

Moreover, in a separate manner from the case in which polyurethane is used as the main ingredient forming the developing roller 41, when EPDM is used as the main ingredient, the EPDM, which contains ethylene, propylene and the third ingredient, for example, ethylidene norbornane, 1,4-hexadiene, etc., that are appropriately blended, is preferably set so as to have an ethylene content of 5 to 95 parts by weight, a propylene content of 5 to 95 parts by weight and a third-ingredient content of 0 to 50 parts by weight at iodine value. Here, the amount of blend of the carbon black is preferably set at 1 to 30 parts by weight with respect to 100 parts by weight of EPDM so as to obtain a superior dispersing property. The carbon black to be used is ISAF, HAF, GPF, SRF, etc. as described above.

Moreover, in addition to carbon black serving as a resistance-adjusting material, an ion conductive substance serving as a resistance-adjusting base material, such as sodium perchloric acid and tetraethylammonium chloride, and a surface active agent, such as dimethylpolysiloxane and polyoxyethylenelauryl ether, are preferably added by an amount of 0.1 to 10 parts by weight with respect to 100 parts by weight of EPDM; thus, it becomes possible to provide a better dispersion homogeneity.

Examples of the ion conductive material include, inorganic ionic conductive materials, such as sodium perchloric acid, calcium perchloric acid and sodium chloride, or organic ionic conductive materials, such as modified aliphatic dimethylethylammonium ethosulfate, stearyl ammonium acetate, lauryl ammonium acetate and octadecyltrimethylammonium perchlorate. Any one of these materials may be used, or a plurality of them may be used in combination.

[Structure of a blade used for a toner-layer thickness regulating member]

As illustrated in FIG. 1, a blade 43 has its one end secured to the developer vessel 40 with a predetermined length, while the free end, not secured, is pressed onto the developing roller 41 with a predetermined pressure. In particular, the one end of the blade 43 is secured to the developer vessel 40 in a manner so as to make itself contact the developing roller 41 by utilizing, for example, its own spring property.

Moreover, the blade 43, which is a metal plate having a plate thickness of approximately 0.05 to 0.5 mm, is allowed to elastically distort in its inherent spring property, and comes into contact with the developing roller 41 with a predetermined pressure so that the toner layer 45 is regulated to a predetermined thickness with a predetermined quantity of static charge. For example, the tip portion of the blade 43, which contacts the developing roller 41, is subjected to a bending process so that it has a face that slightly tilts in a direction so as to widen the angle made by the developing roller 41 and the bent blade 43 as spaced from the surface of the developing roller 41. Moreover, in some cases, the contact portion of the blade 43 with respect to the developing roller 41 is subjected to a coating process so as to adjust the quantity of toner static charge and suppress fusion in the toner.

Figure 12:
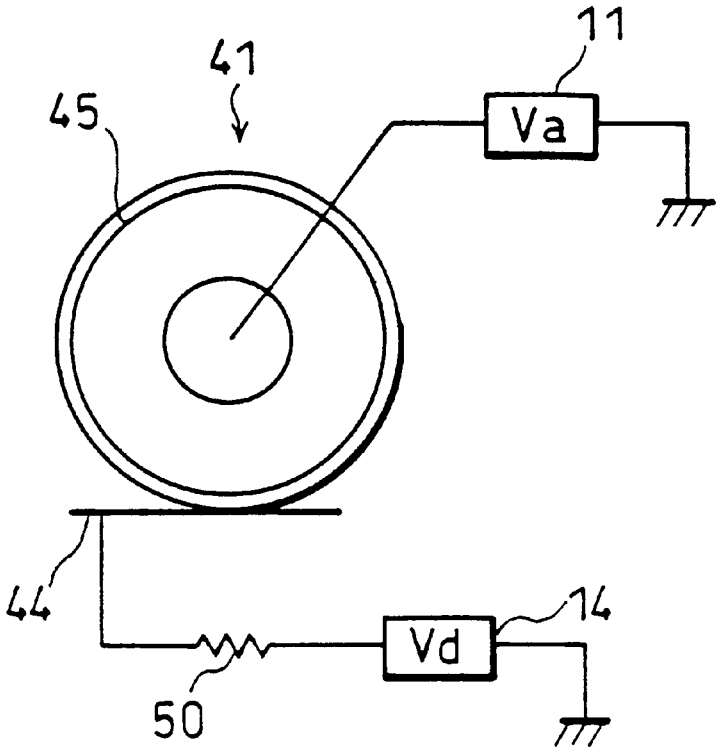
FIG. 12 is a drawing that shows a structure of a reset section after a developing process, which is one example that explains a protective resistor for preventing overcurrents that is used in the developing device of the present invention.
Figure 12A:
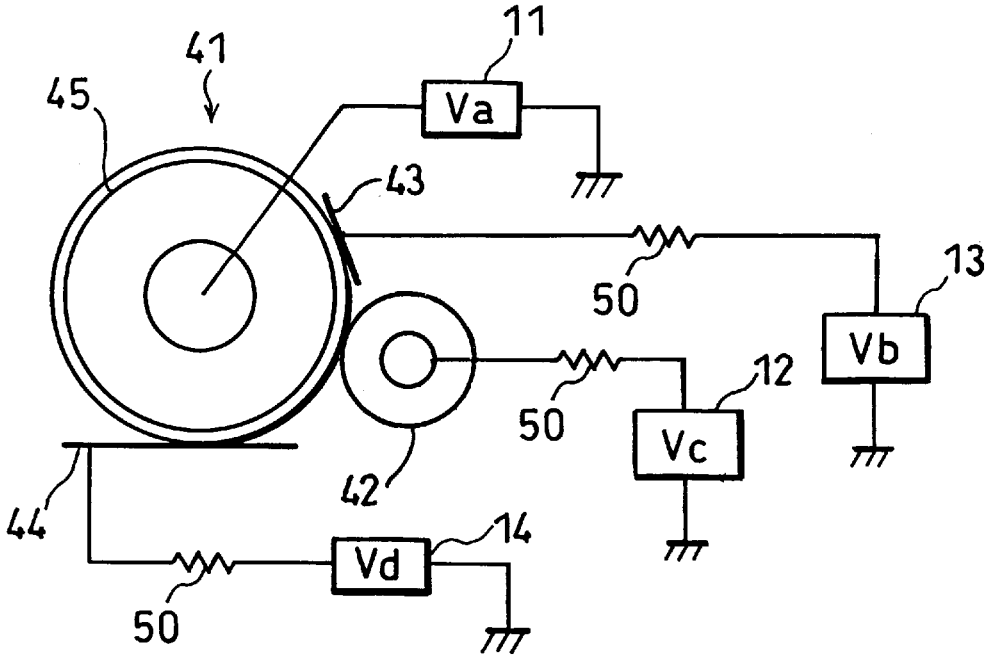
FIG. 12A is a drawing that shows a structure of another example of protective resistors for preventing overcurrents that is used in the developing device of the present invention.

With respect to the material for the blade 43, normally, a material having a spring property is used; for example, spring steels, such as SUS including stainless FIG. 12A is a drawing that shows a structure of another example of protective resistors for preventing overcurrents that is used in the developing device of the present invention. steel such as SUS301, SUS304, SUS420J2 and SUS631, and copper alloys, such as C1700, C1720, C5210 and C7701, may be used.

Moreover, the fine tilt face of the free end of the blade 43 is formed by a processing method in which: a chip-shaped tip portion, which has been preliminarily manufactured by mechanical cutting, grinding, a bending process or a molding process into a predetermined shape, is bonded by using a conductive bonding agent, etc., or the blade tip portion is subjected to a step-forming process and metal foil is bonded thereto by using a conductive bonding agent, etc.

The blade 43, when used, is basically made in contact with the developing roller 41 in the form of the above-mentioned member as it is. However, in some cases, coating is provided on the contact face with the developing roller 41 so as to stabilize the quantity of toner static charge and to suppress toner fixing. With respect to the coating material and process, for example, the following processes are adopted in which: the blade surface is spray-coated with a fluorine-containing resin or a graphite-containing resin, and after having been dried for not less than 30 minutes at approximately 80° C., this is baked for 30 minutes at 260° C., and then slightly ground with sand paper of #10000 so as to provide a film thickness of 8 to 12 $\mu$m; or aluminum formed on the blade surface is subjected to an anodic oxidation so as to provide an alumite coat thereon with a thickness of approximately 50 to 100 $\mu$m.

[Structure of the reset member]

In FIG. 1, the reset member 44 is allowed to directly contact toner after a developing process, while being pressed onto the developing roller 41, so that it eliminates a static charge and separates the toner from the developing roller 41 so as to be reused.

Besides this structure, a corona charger may be used to eliminate a static charge, or a rotary member for contact separation may be installed so as to separate the toner from the developing roller 41 so as to be reused.

In the reset member 44 as shown in FIG. 1, a plate-shaped elastic member is used, and this is pressed onto the developing roller 41 with an appropriate pressure in the same manner as the blade 43, and allowed to static-eliminate and remove toner to be recovered after a developing operation, with a bias voltage Vd from the power-supply circuit 14 being supplied thereto. Therefore, with respect to a material for the elastic member, nylon, PET (polyethylene-terephthalate), a PTFE(polytetrafluoroethylene)-containing resin, or polyurethane, etc., is used; and an electric-resistance adjusting material is added to this serving as a base material (main component) so as to provide an appropriate electric resistance. A reset voltage Vd is supplied from the power supply 14 to the reset member 44 having such a resistance.

With respect to carbon black used as the electric-resistance adjusting material, a furnace or channel black such as ISAF, HAF, GPF, SRF, etc., which has a nitrogen-adsorption specific surface area of not less than 20 $m^2/g$ to not more than 130 $m^2/g$, is used, and not less than 10 parts by weight (in some cases, not more than 70 parts by weight) of this is blended to 100 parts by weight of polyurethane (or nylon, PET, or other resins in the same manner).

[Non-magnetic one-component developer]

With respect to toner that is a non-magnetic one-component developer 10, a material, which consists of 80 to 90 parts by weight of a styrene-acrylic copolymer and 5 to 10 parts by weight of carbon black or 0 to 5 parts by weight of a charge-control agent, is mixed, kneaded, pulverized and classified, thereby obtaining a negatively chargeable toner having an average particle size of 5 to 10 $\mu$m. To this toner is internally or externally added 0.5 to 1.5 parts by weight of silica ($SiO_2$) so as to provide a better fluidity, thereby obtaining a non-magnetic one-component developer 10.

With respect to the toner of the present invention, not limited to a negatively chargeable toner, a positively chargeable toner may be obtained. This is easily achieved by appropriately select a binding resin as the main component, a charge-control agent, etc. Moreover, not limited to black toner used for monochrome copying machines and printers, the present toner may also be applied to color toner used for color copying machines and printers.

Moreover, not limited to the above-mentioned composition materials, the non-magnetic one-component developer, which has any of the following compositions, may also be applied to the developing device of the present invention.

With respect to a thermoplastic resin that forms the binding resin as a main component, in addition to styrene-acrylic copolymer, a material such as polystyrene, polyethylene, polyester, low molecular polypropylene, epoxy, polyamide and polyvinylbutylal, may be used.

With respect to colorants, in the case of black toner, in addition to the above-mentioned carbon black, a material, such as furnace black, a nigrosine dye and a metal-containing dye, may be used. With respect to color toners, yellow dyes and pigments include benzidine yellow pigments, Phonon Yellow, anilide acetoacetate insoluble azo pigments, monoazo pigments, azomethine pigments, etc.; magenta dyes and pigments include xanthene magenta dyes, phosphortungsten-molybdenum acid lake pigments, anthraquinone dyes, coloring materials made of a xanthene dye and an organic carboxylic acid, Thioindigo, naphthol insoluble azo pigments, etc.; and cyan dyes and pigments include copper phthalocyanine pigments, etc.

Moreover, with respect to the toner fluidizing material, besides silica as an externally added agent, materials such as colloidal silica, titanium oxide, alumina, zinc stearate and polyvinylidene fluoride, and a mixture of these may be used.

Furthermore, with respect to the charge-control agent, materials for negatively chargeable toners include azo metal-containing dyes, metal complex salts of organic acids, chlorinated paraffin, etc. Materials for positively chargeable toners include nigrosine dyes, metal salts of fatty acids, amines, quaternary ammonium salts, etc.

[Occurrence of developing ghost images due to particle-size fluctuations]

With respect to mechanisms of how developing ghost images occur, various factors are listed, and the following description will discuss a mechanism of how developing ghost images occur due to particle-size fluctuations.

In the developing device 4 using a one-component developer as described earlier, the blade 43 which is pressed against the developing roller 41 is used to regulate the amount of adhesion of toner 10 to a constant layer thickness. Thereafter, the toner 10 develops an electrostatic latent image on the surface of the photoconductive member 1 that has been transported to the developing area. In this case, bias voltages Va, Vc and Vb are supplied to the developing roller 41, the supply roller 42 and the blade 43 respectively. Here, if residual toner 10, which remains on the developing roller 41 after having developed a white image portion, is not sufficiently removed from the developing roller 41, the same toner is again subjected to a mechanical load by the supply roller 42 and the blade 43, and also subjected to an electrical load (coulomb force) exerted by a bias voltage. When the toner has been continuously subjected to this mechanical load, toner cracking occurs, in particular, in the case of a pulverized toner, and the toner tends to have a smaller average particle size at a portion that has developed a white image portion.

Moreover, at positions to which the bias voltage has been applied, the toner to be developed comes to have no smaller particle-size selectivity. In other words, the toner particles shift in accordance with the bias electric field starting with those having a smaller particle size; therefore, at the portion that has developed a white image portion, the closer to the surface of the developing roller, the smaller the particle size, while at portions that have developed black image portions, hardly any fluctuation has occurred in the particle size since those portions have been refreshed by the developing process. Therefore, if residual toner 10, which remains on the developing roller 41 after a developing process, is not sufficiently removed from the developing roller 41, the toner average particle size is minimized.

Figure 10:
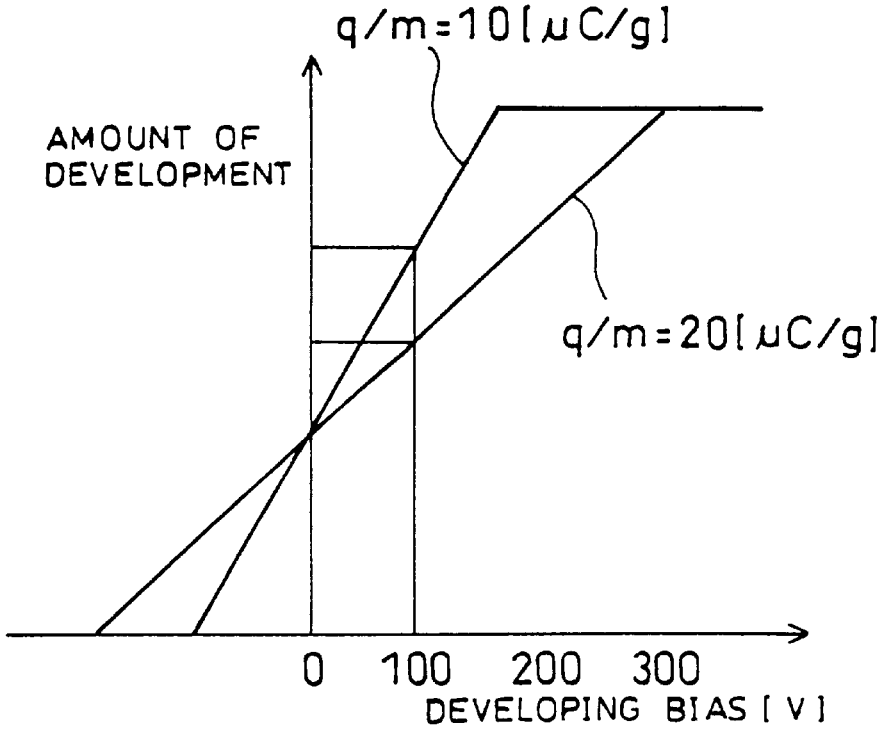
FIG. 10 is a drawing that shows the relationship between the toner specific charge and the developing characteristic in the developing device of the present invention.
Figure 14:
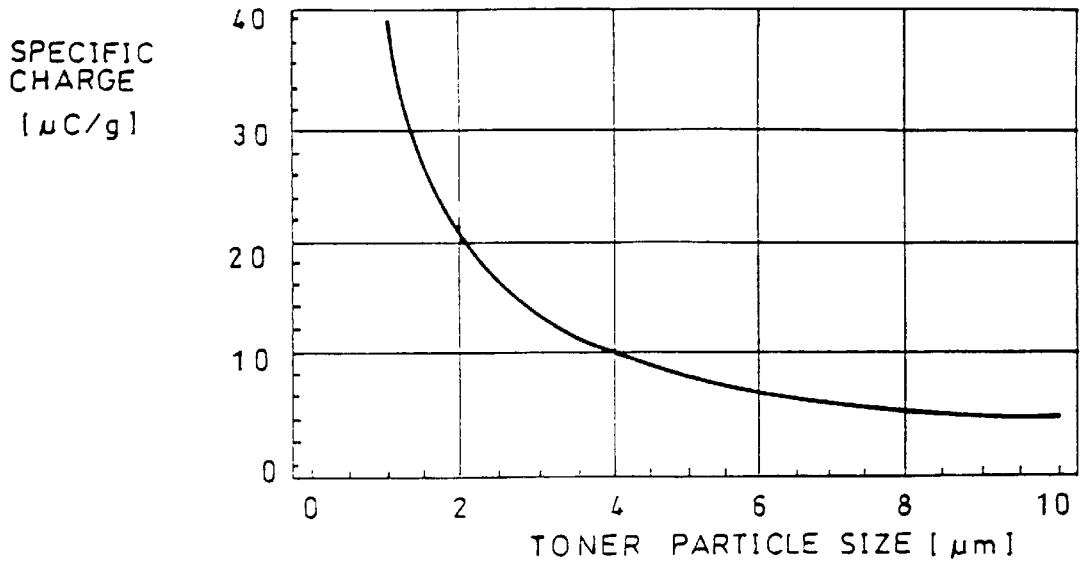
FIG. 14 is a graph that shows the relationship between the particle size and the specific charge of a generally-used one-component developer that is adopted in the developing device of the present invention.

Supposing that the density of electric charge on the surface of toner is constant with respect to the charging characteristic of the toner 10, the toner specific charge is inversely proportional to the particle size as shown in FIG. 14. Moreover, with respect to the developing characteristic to the toner specific charge, the greater the toner specific charge, the flatter the developing gamma characteristic, as shown in FIG. 10. Therefore, at the portions having been subjected to the toner having smaller particle sizes in the toner average particle size, the specific charge increases, thereby causing a reduction in the amount of developing.

The particle-size reduction in the toner average particle size depends on image patterns as to whether a white image (non-colored image) is developed or a black image (colored image) is developed. Therefore, depending on image patterns, the specific charge varies, causing fluctuations in the amount of developing. This causes developing ghost images that are exerted by the influence of a previously developed image pattern on the next image, and tends to cause degradation in the image quality. In this case, the specific charge increases at the white portion due to the particle-size reduction, resulting in a reduction in the amount of developing, that is, so-called positive ghosts.

[Occurrence of developing ghost images due to changes in the surface electric potential and fluctuations in the amount of adhesion]

The following description will discuss a mechanism of how developing ghost images occur due to changes in the electric potential on the surface of the developing roller 41 and fluctuations in the amount of toner adhesion to the developing roller 41.

Figure 9:
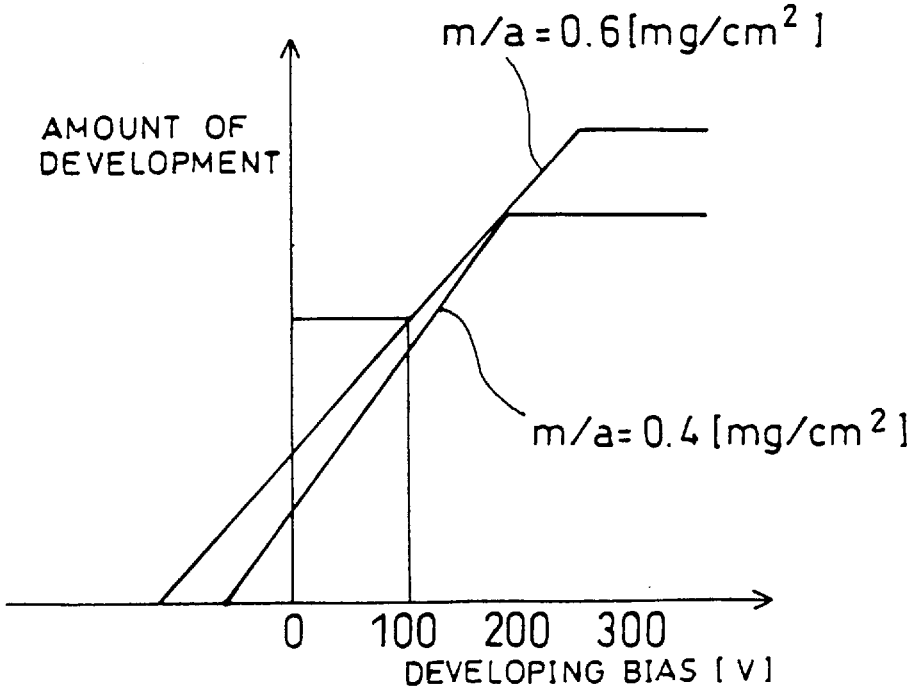
FIG. 9 is a drawing that explains a developing characteristic in which the amount of toner adhesion is used as a parameter in the developing device of the present invention.

The thickness of a toner layer remaining on the developing roller 41 after a black image portion has been developed is very thin as compared with the thickness of a toner layer remaining on the developing roller 41 after a white image portion has been developed. Therefore, in the case of an insufficient toner supply by the supply roller 42 and the blade 43, the portion of the developing roller 41 at which a black image was previously developed has a less quantity of toner adhesion. With respect to the developing characteristic to the quantity of toner adhesion, the smaller the quantity of toner adhesion, the smaller the amount of developing as shown in FIG. 9. In this case, the amount of toner adhesion at a black image portion reduces due to an insufficient toner supply, thereby resulting in a reduction in the amount of developing, that is, so-called negative ghosts.

Figure 11:
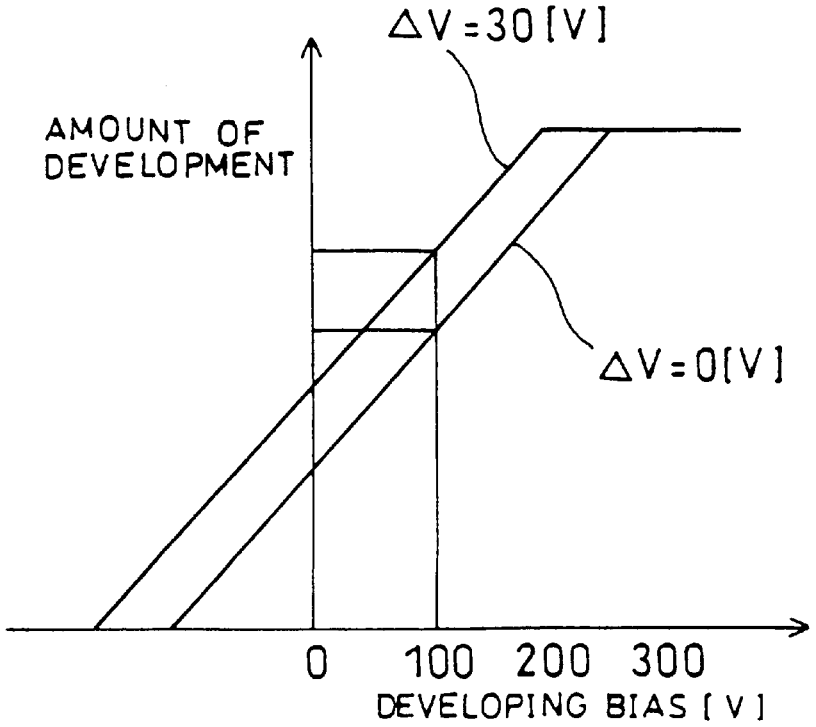
FIG. 11 is a drawing that explains a developing characteristic in which the amount of rise in the surface electric potential of the developing roller is used as a parameter in the developing device in the present invention is used.

Moreover, when bias voltages Va, Vc and Vb have been supplied to the developing roller 41, the supply roller 42 and the blade 43 respectively, the thickness of a toner layer remaining on the developing roller 41 after a black image portion has been developed is very thin as compared with the thickness of a toner layer remaining on the developing roller 41 after a white image portion has been developed; therefore, the black image developing portion has a stronger electric field intensity even upon application of the same electric potential difference, with the result that it is highly susceptible to a toner dielectric breakdown and an overcurrent and a charge tends to be supplied to the surface of the developing roller. In this case, if the resistivity of the developing roller 41 is high, the surface electric potential at the black image developing portion of the developing roller 41 varies since the charge is not released. FIG. 11 shows the relationship between the surface electric potential change AV and the amount of developing in the developing roller 41; and, for example, this graph clearly shows a characteristic in which as the surface electric potential rises, the developing bias increases with the result that the amount of developing increases.

Therefore, in the present invention, the occurrence of developing ghost images is prevented by limiting the difference between the average particle size after developing a black image and the average particle size after developing a white image to a predetermined value range. Moreover, developing ghost images due to fluctuations in the amount of toner adhesion to the developing roller 41 and changes in the surface electric potential of the developing roller 41 are prevented by limiting the resistivities, applied bias voltages, etc. of the respective members so that a stable developing process is obtained.

The stability of a developing process by the use of the above-mentioned developing device of the present invention was confirmed by the following embodiments.

[Embodiment 1]

A negatively chargeable photoconductive member was used as the photoconductive member 1 in the present embodiment. Here, it had a conductive base member having a diameter of 65 mm, and was charged to an electric potential of −550 V by a charger 2. The photoconductive member 1 had its base member grounded, and was rotated at a peripheral speed of 190 mm/sec in the arrow direction.

As illustrated in FIG. 5, the developing roller 41 was constituted by a stainless rotary shaft 41*a* having a diameter of 18 mm the surface of which was coated with a semiconductive elastic layer 46 having a thickness of 8 mm. Thus, the developing roller 41 was constituted by the rotary shaft 41*a* that is conductive and the semiconductive elastic layer 46 that has a flexibility and is formed on the rotary shaft 41*a*. The developing roller 41 was adjusted so that, supposing the resistivity of a portion thereof contacting the photoconductive member 1 through the one-component developer 10 is Rd [Ω], it satisfies $10^4$<Rd<$5\times10^6$. This adjustment was made by using the aforementioned resistance-adjusting base material with a rubber hardness of 65 to 70 degrees on the Asker C hardness standardized by SRIS (Standard Specification; Japan Rubber Association) and a surface roughness of 2 to 8 μm on Rz (ten-point average roughness) standardized by JISB0601. As illustrated in FIG. 1, the developing roller 41 was driven to rotate at a peripheral speed of 285 mm/sec in the arrow direction. Moreover, a voltage of −400 V was supplied to the stainless rotary shaft 41*a* of the developing roller 41 from a power-supply circuit 11 as a developing bias voltage Va, and the developing roller 41 was pressed onto the photoconductive member 1 with a developing nip width of 1.5 mm through a toner layer 45 on the surface of the developing roller 41.

With respect to the supply roller 42, it was constituted by a stainless rotary shaft the surface of which was coated with conductive urethane foam having a volume resistivity of 105 (Ω·cm) and a cell density of 80 to 100 number/inch. Here, the diameter of the supply roller 42 was set at 20 mm, and was allowed to contact the developing roller 41 with a contact depth of 0.5 mm. Then, the supply roller 42 was driven to rotate in the arrow direction at a peripheral speed of 170 mm/sec. A voltage of −500 V was supplied to the stainless rotary shaft of the supply roller 42 by a power-supply circuit 12 as a bias voltage Vc.

The blade 43, used as a developer-layer regulating member, was formed by a stainless plate having a plate thickness of 0.1 mm, and pressed onto the developing roller 41. In particular, the blade 43, which has a cantilever plate-spring structure, had its free end come into contact with the developing roller 41, and was elastically distorted so as to apply a predetermined pressure onto a toner layer formed on the surface of the developing roller 41. A voltage of −500 was also applied to the blade 43 as a bias voltage (Vb) from a power-supply circuit 13.

Moreover, the reset member 44, which is provided as a sheet-shaped elastic member formed by dispersing carbon in a resin base material, was designed to come into face-contact with the developing roller 41 with a predetermined pressure. A voltage of −300 V was also supplied to the reset member 44 as a reset bias voltage (Vd) by a power-supply circuit 14.

As described above, in the present embodiment of the developing device 4, the voltage Va [V] to be applied to the developing roller 41 and the voltage Vd [V] to be applied to the reset member are set so that the sign of Va−Vd is equal to that representing the polarity of a charge of the toner. More specifically, in the present embodiment, a negatively chargeable toner is used, and Va−Vd is (−400 V)−(−300 V)=−100 V.

Consequently, since the negatively chargeable toner is attracted toward the reset member 44 side, toner that remains on the developing roller 41 after a white-image developing process is removed and static-eliminated so that the same condition as that after a black-image developing process is provided. With this arrangement, the difference between the toner average volume particle size after developing a black image and the toner average volume particle size after developing a white image can be minimized, thereby making it possible to solve the problem of developing image ghosts.

Moreover, the voltage Va [V] to be applied to the developing roller 41 and the voltage Vb [V] to be applied to the blade 43 are set so that the sign of Va−Vb represents a polarity reversed to the polarity of a charge of the toner. More specifically, in the present embodiment using the negatively chargeable toner, Va−Vb is (−400 V)−(−500 V)=+100 V.

This makes it possible to attract the negatively chargeable toner to the developing roller 41.

Moreover, supposing that the voltage to be applied to the developing roller 41 is Va [V] and that the voltage to be applied to the supply roller 42 is Vc [V], the sign of Va−Vc represents a polarity reversed to the polarity of a charge of the toner. More specifically, in the present embodiment using the negatively chargeable toner, Va−Vc is +100 V=(−400 V)−(−500 V).

This makes it possible to attract the negatively chargeable toner to the developing roller 41.

In the developing device having the above-mentioned structure, a uniform toner thin film 45 was formed on the developing roller 41, and the aforementioned contact inversion developing process was carried out on the photoconductive member 1. In this case, the quantity of toner adhesion m/a was set at 0.5 to 0.8 mg/cm$^2$, the quantity of toner charge q/m was set at −10 to −20 μC/g, and the thickness Dt of the toner layer was set at 10 to 30 μm.

Figure 15:
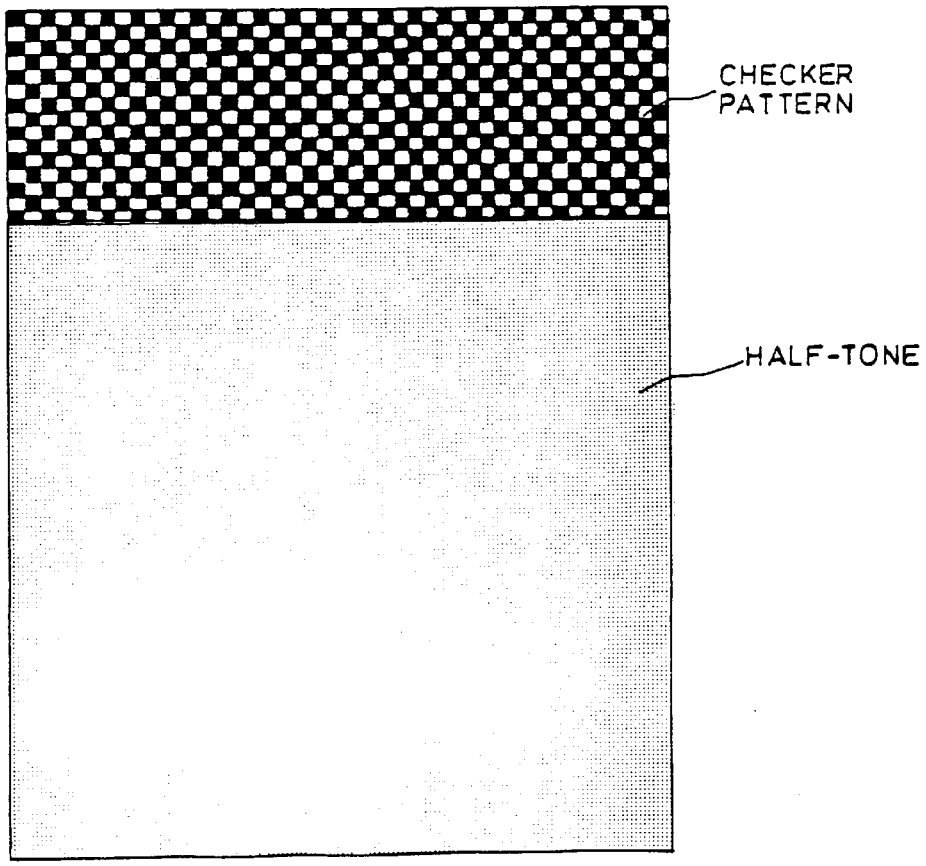
FIG. 15 is an image pattern used for evaluating the presence or absence of developing image ghosts in the developing device of the present invention.

FIG. 15 shows an image pattern used for evaluating developing ghost images, in which a black and white checker pattern is placed at the leading portion of an image corresponding the first rotation of the developing roller and a uniform half-tone pattern is placed at the succeeding portion of the image corresponding to the second rotation and thereafter of the developing roller. Evaluation on developing ghost images was made by visual observation and a Machbeth densitometer RD 918.

Figure 2:
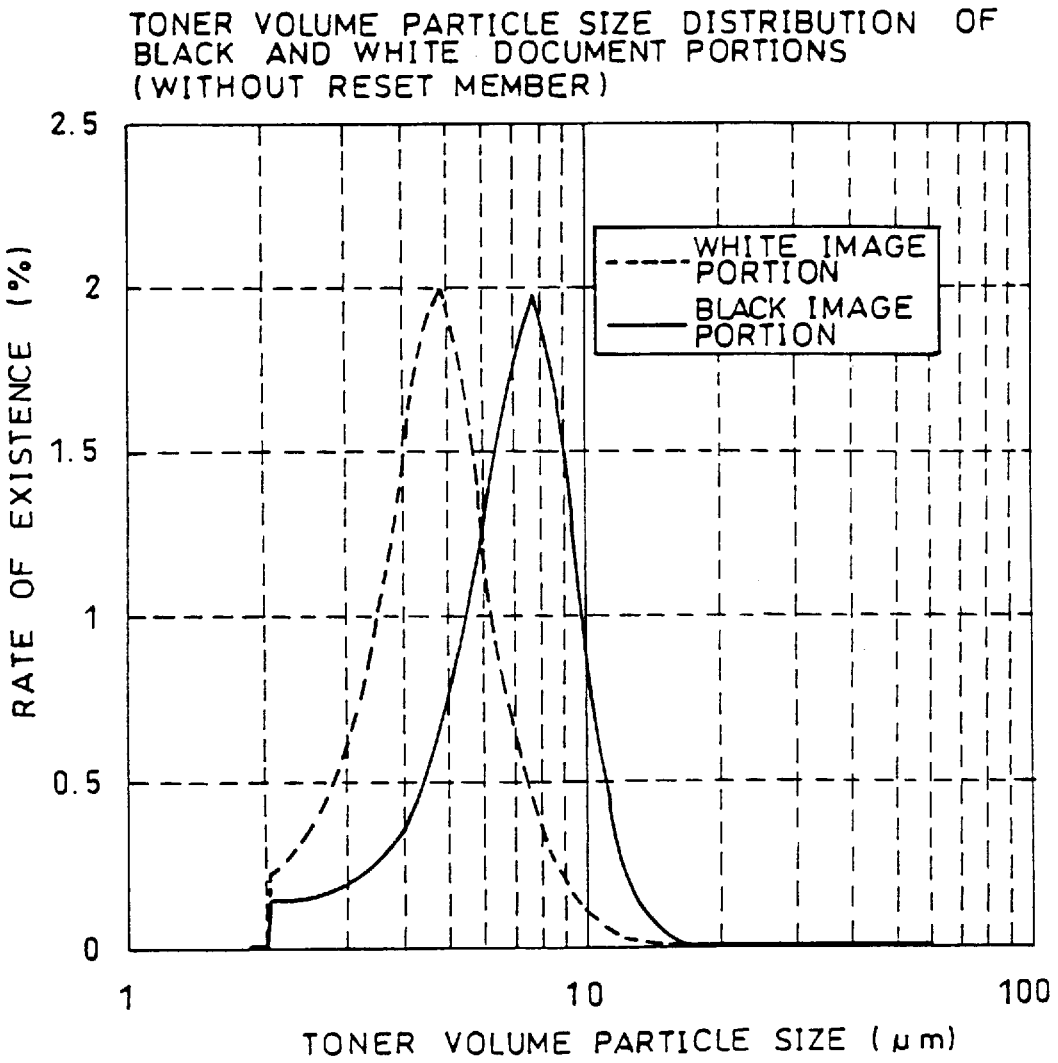
FIG. 2 is an explanatory drawing that shows fluctuations in the volume particle size distribution in the case when a reset member is omitted from the developing device in FIG. 1.

In the above-mentioned developing device, measurements were carried out so as to observe how the volume particle-size distribution of a commonly-used pulverized one-component developer would fluctuate by performing developing operations in the structure from which the reset member was excluded. The results of the measurements are shown in FIG. 2. The measurements on the volume particle-size distribution were carried out by using a Multisizer 2 made by Coulter Co., Ltd. A solid line represents a volume particle-size distribution of toner possessed by a portion on the developing roller immediately after it has passed through the developer-layer regulating member. In this case, the portion in question lost most of its toner when it was subjected to a black-image developing process at the developing section, and is again rotated to pass through the developer-layer regulating member. A broken line represents a volume particle-size distribution of toner possessed by a portion on the developing roller immediately after it has passed through the developing-layer regulating member. In this case, the portion in question still had most of its toner remaining thereon after it had been subjected to a white-image developing process at the developing section, and is again rotated to pass through the developer-layer regulating member.

The volume-average particle size Dbk of the black portion, indicated by the solid line, is 7.6 μm which is virtually the same as the toner volume-average particle size inside the developer vessel. In contrast, the volume-average particle size Dwt of the white portion, indicated by the broken line, is 4.8 μm which has been greatly reduced in particle-size. The ratio of the volume-average particle size Dbk of the black portion and the volume-average particle size Dwt of the white portion is represented by equation (1).

$$Dwt/Dbk=0.63 \quad (1)$$

At this time, the specific charge was −10 μC/g at the black portion, and −14 μC/g at the white portion. Thus, it was confirmed that the specific charge increases as the particle size reduces. When the above-mentioned developing ghost evaluation pattern was developed under these conditions, positive ghosts were observed.

Figure 3:
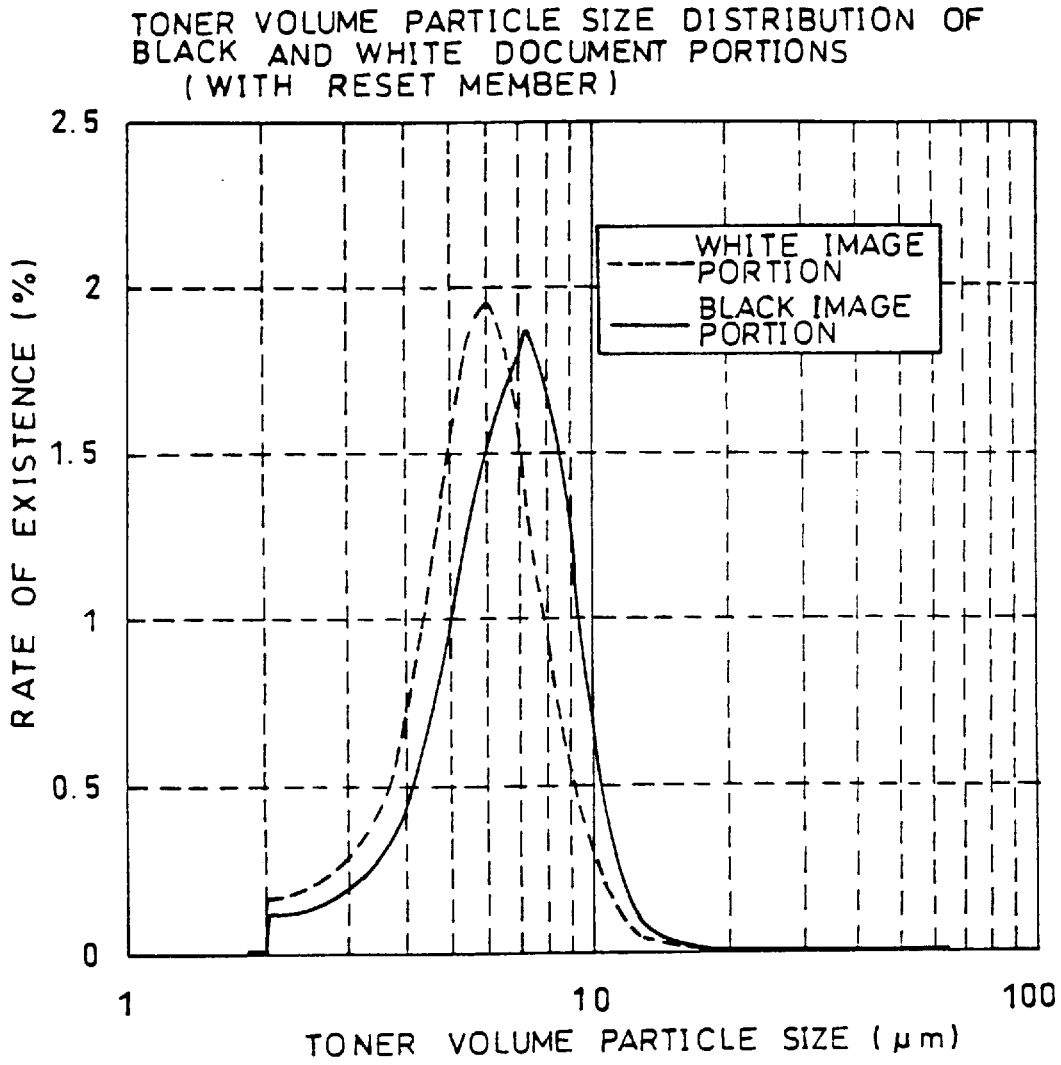
FIG. 3 is an explanatory drawing that shows fluctuations in the volume particle size distribution in the case when the reset member is used in the developing device in FIG. 1.

Next, in the above-mentioned developing device to which the reset member was incorporated, developing operations were carried out so as to measure fluctuations in the toner volume particle size distribution, and the results of the measurements are listed in FIG. 3. A solid line represents a volume particle-size distribution of toner possessed by a portion on the developing roller immediately after it has passed through the developer-layer regulating member. In this case, the portion in question lost most of its toner when it was subjected to a black-image developing process at the developing section, and is again rotated to pass through the developer-layer regulating member. A broken line represents a volume particle-size distribution of toner possessed by a portion on the developing roller immediately after it has passed through the developing-layer regulating member. In this case, the portion in question still had most of its toner remaining thereon after it had been subjected to a white-image developing process at the developing section, and is again rotated to pass through the developer-layer regulating member. The volume-average particle size Dbk of the black portion, indicated by the solid line, is 7.6 μm which is virtually the same as the toner volume-average particle size inside the developer vessel. In contrast, the volume-average particle size Dwt of the white portion, indicated by the broken line, is 6.1 μm, which shows that the particle-size reduction has been suppressed as compared with the case without a reset member. The ratio of the volume-average particle size Dbk of the black portion and the volume-average particle size Dwt of the white portion is represented by equation (2).

$$Dwt/Dbk=0.80 \quad (2)$$

At this time, the specific charge was −10 μC/g at the black portion, and −11 μC/g at the white portion. Thus, it was confirmed that the fluctuations in the specific charge become smaller. When the above-mentioned developing ghost evaluation pattern was developed under these conditions, no positive ghosts were observed.

Besides the above-mentioned experiments, various experiments were carried out using various toners under various conditions so that the relationship between the particle-size fluctuation and the presence or absence of ghost images was evaluated. Table 1 shows some typical examples of the results of those experiments.

TABLE 1

| | Experimental Conditions | Toner CV value | Particle Size Fluctuation (k) | Ghost |
|---|---|---|---|---|
| 1 | No reset member | 34.6% | 0.63 | Yes |
| 2 | Reset member Vd − Va = 0V | 34.6% | 0.74 | Yes |
| 3 | Reset member Vd − Va = 50V | 34.6% | 0.77 | Yes |
| 4 | Reset member Vd − Va = 100V | 34.6% | 0.80 | No |
| 5 | Reset member Vd − Va = 200V | 34.6% | 0.85 | No |
| 6 | No reset member | 25% | 0.82 | No |
| 7 | Reset member Vd − Va = 100V | 25% | 0.90 | No |

* With respect to the particle size fluctuation k, "Dwt" = k "Dbk" holds.

With respect to a specific evaluation method on the presence or absence of ghosts, optical density evaluation obtained by a Machbeth densitometer and visual observation were used in a combined manner.

More specifically, the optical densities of the white portion and the black portion of a developing ghost image of the black and white checker pattern appearing on the half-tone portion were measured, and the rate of residual ghost was calculated based on the following expression (3):

$$\frac{\{(\text{ghost black-portion density})\} - \{(\text{ghost white-portion density}\}}{\{(\text{ghost black-portion density})\} + \{(\text{ghost white-portion density}\}} \times 100[\%] \quad (3)$$

If the rate of residual ghost images obtained by the above expression 3 is not less than 3%, it is judged that image ghosts exist, and if the rate is not more than 1%, it is judged that no ghost images exist. If the rate is in the range from 1 to 3%, a judgement as to whether or not ghost images exist was made by visual observation.

It is found from the results that no ghost image is generated when the difference between the black-portion volume-average particle size Dbk and the white-portion volume-average particle size Dwt satisfies the following inequality (4):

$$Dwt/Dbk>0.8 \quad (4)$$

In this manner, by controlling and limiting the difference in the volume-average particle size between the black-image developing portion and the white-image developing portion to the range indicated by the above-mentioned inequality (4), it is possible to maintain the change in the average quantity of specific charge that depends on image patterns within a constant value range; therefore, it becomes possible to prevent the generation of ghost images, and consequently to provide a developing device which can carry out a desired developing process.

[Embodiment 2]

The following description will discuss another embodiment of the present invention. For convenience of explanation, those of the members described in embodiment 1 are indicated by the same reference numerals and the description thereof is omitted. The developing device 4 of the present embodiment has the same arrangement as the developing device 4 of the above-mentioned embodiment 1 except that the reset member 44 is omitted.

In other words, as will be explained below, the developing device 4 of the present embodiment has an arrangement which can prevent developing ghost images caused by fluctuations in the volume particle size by improving the distribution of toner volume particle sizes, even if the reset member is omitted.

The CV value (Coefficient of Variation) [%] as defined by the following equation 5 is used as an index for indicating the sharpness of the distribution of the volume particle sizes of the toner. The greater the CV value, the broader the distribution of the volume particle sizes, and the smaller the CV value, the sharper the distribution of the volume particle sizes.

$$CV=100\times(\text{Standard deviation}/\text{Average value}) \quad (5)$$

In the above-mentioned embodiment 1, a toner having a CV value of 34.6% was used, and when the reset member was not used, developing ghost images occurred due to fluctuations in the distribution of the volume particle sizes as shown in Table 1.

Here, when a toner having a small CV value is used, the ratio of smaller toners or greater toners with respect to the volume average particle size becomes smaller. Therefore, it is assumed that the fluctuations in the volume average particle size also becomes smaller. Based upon this assumption, toners having various CV values were tested, with the result that it was confirmed that toners whose CV value is set at not more than 25% are not susceptible to developing ghost images even without installing the reset member (see Table 1). Therefore, with respect to the one-component developer 10 of the present invention, it is preferable to use toners whose CV value is not more than 25%.

However, as a result of tests carried out using the toner layer thickness 45 as a parameter, it is found that, even in the case of the application of a toner having a CV value of 25%, when the amount of toner adhesion to the developing roller 41 is great, more specifically, when the toner layer thickness exceeds three times the volume average particle size, fluctuations in the particle sizes take place to such an extent that developing ghost images might appear. Therefore, supposing that the toner layer thickness maintained on the developing roller 41 is T [$\mu$m] and that the average volume particle size is D [$\mu$m], it is preferable that the following inequality be satisfied:

$$T<3\times D.$$

The above-mentioned CV value and the toner layer thickness exert their synergistic effect so as to suppress the occurrence of developing ghost images, and it is easily predict that, for example, even when the toner layer thickness exceeds three times the volume average particle size of the toner layer thickness, it is possible to prevent the occurrence of developing ghost images by reducing the CV value to not more than 25%. Here, the same is true for the synergistic effect with the reset member 44.

[Embodiment 3]

Referring to Figures, the following description will discuss still another embodiment of the present invention. For convenience of explanation, those of the members described in embodiment 1 are indicated by the same reference numerals and the description thereof is omitted.

In the present embodiment and embodiments 4 through 6 that will be described later, explanations will be given of arrangements which can prevent degradation in the image quality due to an over-current and fluctuations in electric potential on the surface of the developing roller 41 by limiting the value of resistivity and the bias voltage of a member relating to toner formation in the same construction as the developing device 4 in the aforementioned embodiment 1.

In the developing device 4 of the present invention, in order to stabilize the layer thickness and the quantity of charge of the toner layer 45, bias voltages are supplied to the developing roller 41 and various members placed on the periphery of the developing roller 41, that is, the supply roller 42, the blade 43 and the reset member 44.

A conventional developing device, which has higher resistivities in the above-mentioned parts, is less susceptible to a discharge due to the bias voltages; however, in the developing device of the present invention, since all the above-mentioned parts are constituted by low-resistance materials, it is necessary to determine the upper limit values of the bias voltages applied to the respective members.

For this reason, first, it is imperative to set the upper limit values of bias voltages to be applied to the respective members so as not to cause a discharge in response to a bias voltage supplied to the toner layer 45.

Therefore, the following description will discuss the toner layer resistance, the toner layer thickness and the bias-voltage applying means that are used in the developing device of the present invention.

FIG. 5 is a drawing that explains a method for measuring the resistivity Rt of the toner layer 45 between the developing roller 41 and the photoconductive member 1.

In the Figure, instead of the photoconductive member 1, an aluminum material cylinder 100 was used, and after a toner layer 45 had been uniformly formed on the surface of the developing roller 41 having the same structure as that used under actual developing conditions, this was made in contact with the aluminum material cylinder 100 with the same pressure as that applied in an actual operation. Then, in a state where the respective members were standing still, virtually the same developing bias voltage Vl as the developing bias voltage Va was applied thereto by the power supply 101. Then, the current It flowing through the toner layer 45 was measured precisely by using a minute ampere meter 102. Thus, the static resistivity Rt of the toner layer 45 was measured.

In this case, by making measurements in a state where the respective members are standing still, it becomes possible to measure the quantity of the current precisely while excluding noise factors such as a toner static charge current and a toner transition current occurring during an operational state.

Here, supposing that the supplied voltage by the power supply 101 is Vl (V) and the measured current by the minute ampere meter 102 is It (A), the static resistivity Rt (Ω) of the toner layer 45 is found from the following equation (6).

$$Rt=Vl/It \quad (6)$$

Here, since the resistivity of the developing roller 41 used in the present invention is sufficiently low as compared with the toner resistivity, a voltage drop of the measuring device shown in FIG. 5 due to the semiconductor layer 46 of the developing roller 41 was ignored.

Figure 6:
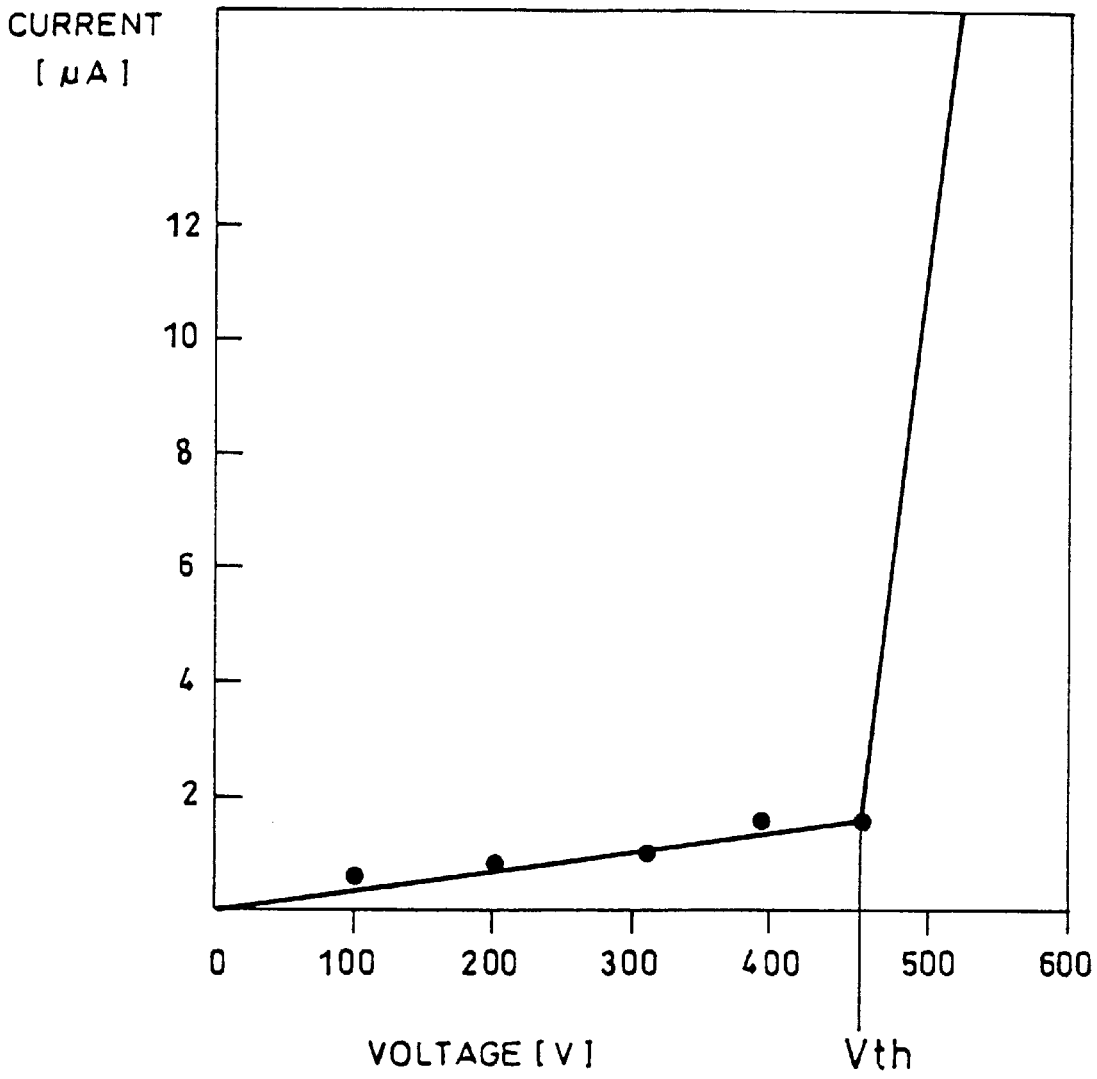
FIG. 6 is a graph that shows a voltage-current characteristic which is one example of the results of measurements on the still resistivity of the toner in a thin-film state used in the developing device of the present invention.

The static resistivity (Rt) of the toner layer 45 was measured by using the above-mentioned method, and the results of the measurements were plotted as the voltage-current characteristic of the toner layer 45 as shown in FIG. 6.

The current of the toner layer thus measured exhibits a comparatively linear characteristic at a low voltage section, and shows that it has an over-current flow abruptly when it reaches a certain value Vth (V). This value Vth corresponds to a discharge starting voltage at which an aerial discharge or a creeping discharge occurs between the toner particles.

Since the current-voltage relationship shows the comparatively linear characteristic within a voltage range not more than the discharge starting voltage Vth, the resistivity, found from equation (6) based upon current values measured by using voltages in this range, is defined as the static resistivity Rt of the toner layer 45.

Under various conditions in accordance with embodiment 1, developing experiments were carried out by using toners having various resistivities, and the results show that when a toner having a high insulating property of not less than 50 M($5\times10^6$)Ω, and more preferably not less than 100 MΩ, is used, it becomes possible to minimize the occurrence of the over-current, and consequently to obtain desired image quality.

However, even in the case when the above-mentioned highly resistant toner is used, if the bias voltages, applied to the supply roller 42, the blade 43 and the reset member 44 that are placed on the periphery of the developing roller, are increased and the voltage differences from the developing roller 41 are subsequently widened, the above-mentioned charging start voltage (Vth) is exceeded, with the result that degradation in the image quality occurs due to an over-current.

TABLE 2

| Name of Toner | Rt [MΩ] | Vth [V] |
|---|---|---|
| RV | 313 | 480 |
| BN | 300 | 480 |
| L | 8 | — |
| TW | 52 | 400 |
| KO | 320 | 450 |
| K25 | 277 | 450 |

Condition: Toner layer thickness=20 μm

Table 2 shows the results of measurements that were made on the toner layer resistivity Rt [Ω] of several kinds based upon the measuring method as shown in FIG. 5. As shown in Table 2, the dielectric breakdown voltages Vth [V] of the toners thus measured are 400 to 500 V with respect to a toner layer thickness T[μm] of approximately 20 μm. Therefore, the electric field intensity Eth [MV/m]=Vth/T at the time of the dielectric breakdown ranges from 20 to 25 MV/m. The results show that it is imperative that the upper limit of the voltage to be applicable to the toner layer sandwiched by the low-resistance materials be set at V max=20×T[V]. Therefore, by setting the voltages to be supplied to the toner layer 45 through the supply roller 42 that contacts the developing roller 41, the blade 43 and the reset member 44 at not more than the above-mentioned value, 20×T[V], in accordance with the thickness T of the toner layer 45, it becomes possible to prevent degradation in the developing operation due to a dielectric breakdown of the toner layer 45.

Here, the developing bias voltage Va, the bias voltage Vc, the bias voltage Vb and voltage Vd are respectively applied to the developing roller 41, the supply roller 42, the blade 43 and the reset member 44. For this reason, the respective bias voltages are preferably set so that the absolute value of the difference between the developing bias voltage Va supplied to the developing roller 41 and each of the bias voltages supplied to the supply roller 42, the blade 43 and the reset member 44 is set at not more than the above-mentioned value, 20×T[V].

[Embodiment 4]

Referring to Figures, the following description will discuss still another embodiment of the present invention. For convenience of explanation, those of the members described in embodiment 1 are indicated by the same reference numerals and the description thereof is omitted.

In the present embodiment, an explanation will be given of electrical characteristics of the blade 43 (developer-layer-thickness regulating member), the supply roller 42 and the reset member 44, which constitute the developing device 4 of the present invention.

Even if the voltage to be supplied to the toner layer 45 is below the toner layer discharge starting voltage, the resistivity of the toner layer 45 in a thin-film state has non-uniformity to a certain extent; therefore, in the case of a great current flowing through the toner layer 45, a non-uniform voltage drop occurs in the developing roller 41 due to a non-uniform current. This causes the bias voltage to be supplied to the toner layer 45 to become non-uniform. As a result, the toner layer thickness and the quantity of static charge become non-uniform, causing degradation in the image quality.

FIG. 11 shows a developing characteristic in which the amount of change in the surface potential ΔV on the developing roller 41 is used as a parameter; and as the electric potential on the surface of the developing roller 41 increases, the graph shifts to the left. Therefore, when consideration is given to a portion of the graph at approximately 100 V, that is, a half-tone developing potential, it is noted that the higher the electric potential on the surface of the developing roller 41, the greater the amount of developing.

If a charge, which has adhered to the surface of the developing roller 44 for any reason, does not pass through the semiconductive layer 46 of the developing roller 41 to reach the conductive rotary shaft 41*a*, the surface potential of the developing roller 41 increases. It is dependent on the relationship of sizes between the time constant determined by the resistivity and the static capacitance of the developing roller and the process rate whether or not the surface electric potential of the developing roller 41 increases.

Here, since the developing roller 41 used in the developing device of the present invention has a low resistivity, the time constant is small, and in the case of a peripheral velocity of approximately 285 mm/s of the developing roller 41, it is less likely to have the occurrence of developing ghost images due to a charge accumulated on the surface of the developing roller. However, if a similar phenomenon of changes in the surface electric potential of the developing roller 41 occurs in the toner supplying section, the layer regulating section or the reset section, degradation in the image quality might occur.

Here, with respect to the toner supply roller 42, the rotation speed of the supply roller is determined by selecting the peripheral velocity ratio between it and the developing roller in a range approximately from 0.5 to 2.0. Moreover, the value of the resistivity is determined by the contact nip area, which is determined by the pressing force onto the developing roller and the sponge hardness, and the volume resistivity. The results of experiments carried out by changing these conditions show that the above-mentioned changes in the surface electric potential of the developing roller 41 do not occur if the value of the resistivity is set at not more than 10 kΩ.

Figure 16:
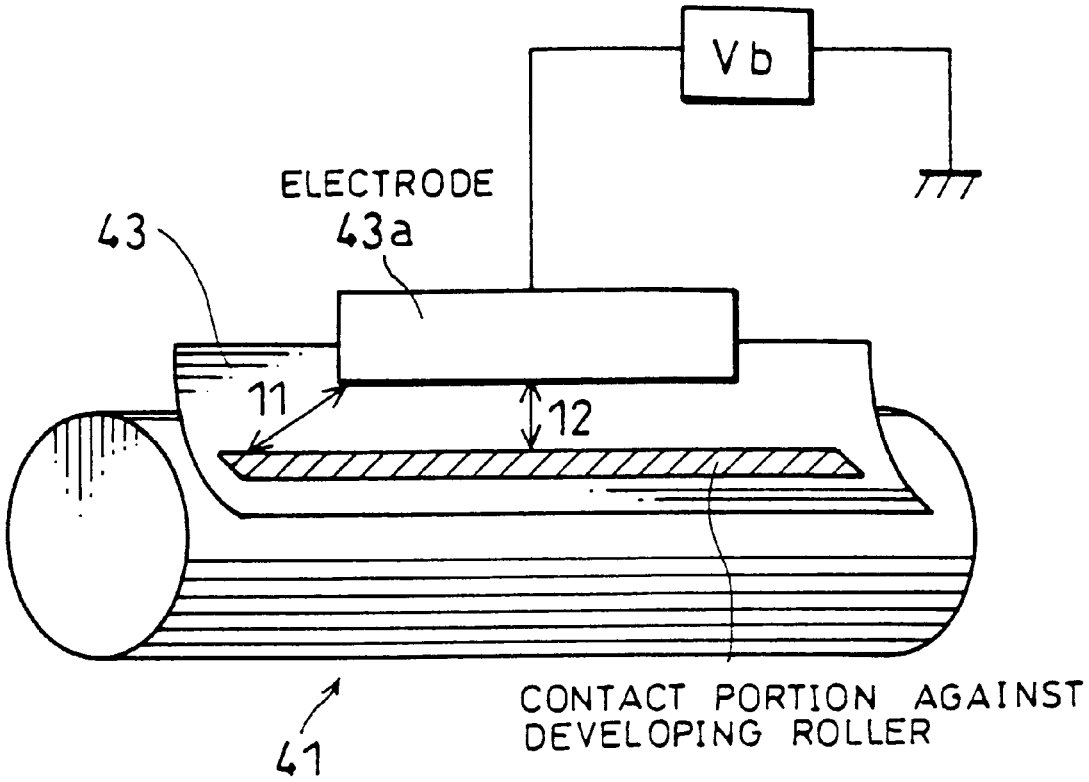
FIG. 16 is an explanatory drawing that shows an appropriate electrode width in the case when a conductive sheet is used as a toner-layer regulating member provided in the developing device of the present invention.
Figure 17:
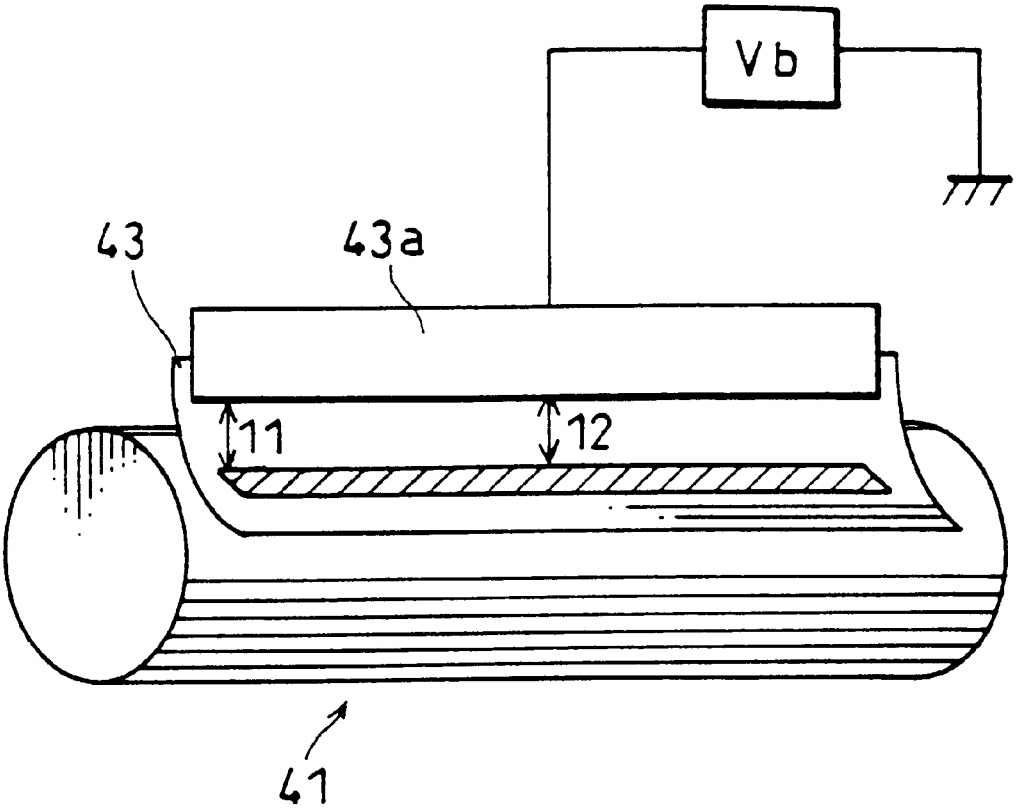
FIG. 17 is an explanatory drawing that shows an appropriate electrode width in the case when a conductive sheet is used as a toner-layer regulating member provided in the developing device of the present invention.

Moreover, when a blade of a metal plate spring is used as the blade 43 for regulating the toner layer, no change in the electric potential occurs on the blade surface in principle. However, in the case of coating with a resin material, etc., having a high electric resistance and an application of a conductive sheet, a potential change occurs, thereby greatly impairing the uniformity of the toner layer 45. Since the blade 43 is a stationary member, whether the surface potential changes or not is determined by the charge accumulating rate of the member and the time constant. Although theoretical values are not definite since the charge accumulating rate is greatly dependent on the electrical characteristics of the toner, the results of experiments carried out using various toners show that, in the case of the application of a coating process or a conductive sheet to the blade 43, it is preferable to select one having a resistivity of not more than 10 kΩ. Here, if the blade 43 is provided as a metal blade, the above-mentioned problems do not arise. Moreover, in the case of the application of the conductive sheet, when the width of an electrode 43*a* (conductor electrode) is narrower than the image width as shown in FIG. 16, a current path 12 in the center and a current path 11 at an end are different from each other, a phenomenon occurs in which the amounts of voltage drop differ between the center and the end. As a result, the applied bias voltage to the blade section becomes non-uniform in the axis direction, resulting in degradation in the image quality. This problem can be avoided by making the width of the electrode 43*a* of the blade 43 longer than the image effective width as illustrated in FIG. 17.

Moreover, it has been confirmed through experiments that, also in the toner reset section for removing toner, since it is a stationary member like the blade section, the problem of electric potential changes on the surface of the developing roller 41 can be solved by setting it to have a resistivity of not more than 10 kΩ in the same manner as the supply roller 42. Therefore, the reset member 44 is preferably made of a metal material or a low-resistivity material which allows a portion thereof contacting the developing roller 41 through the developer to have a resistivity of not more than 10 kΩ.

Figure 18:
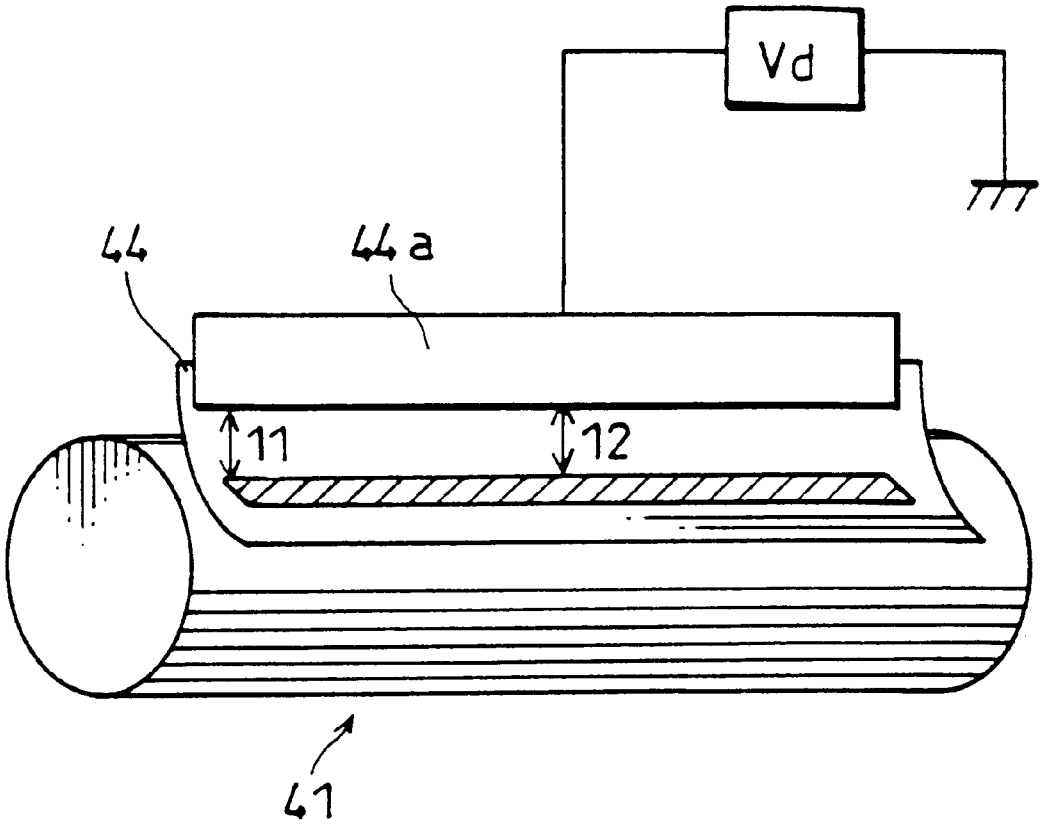
FIG. 18 is an explanatory drawing that shows an appropriate electrode width in the case when a conductive sheet is used as the reset member provided in the developing device of the present invention.
Figure 19:
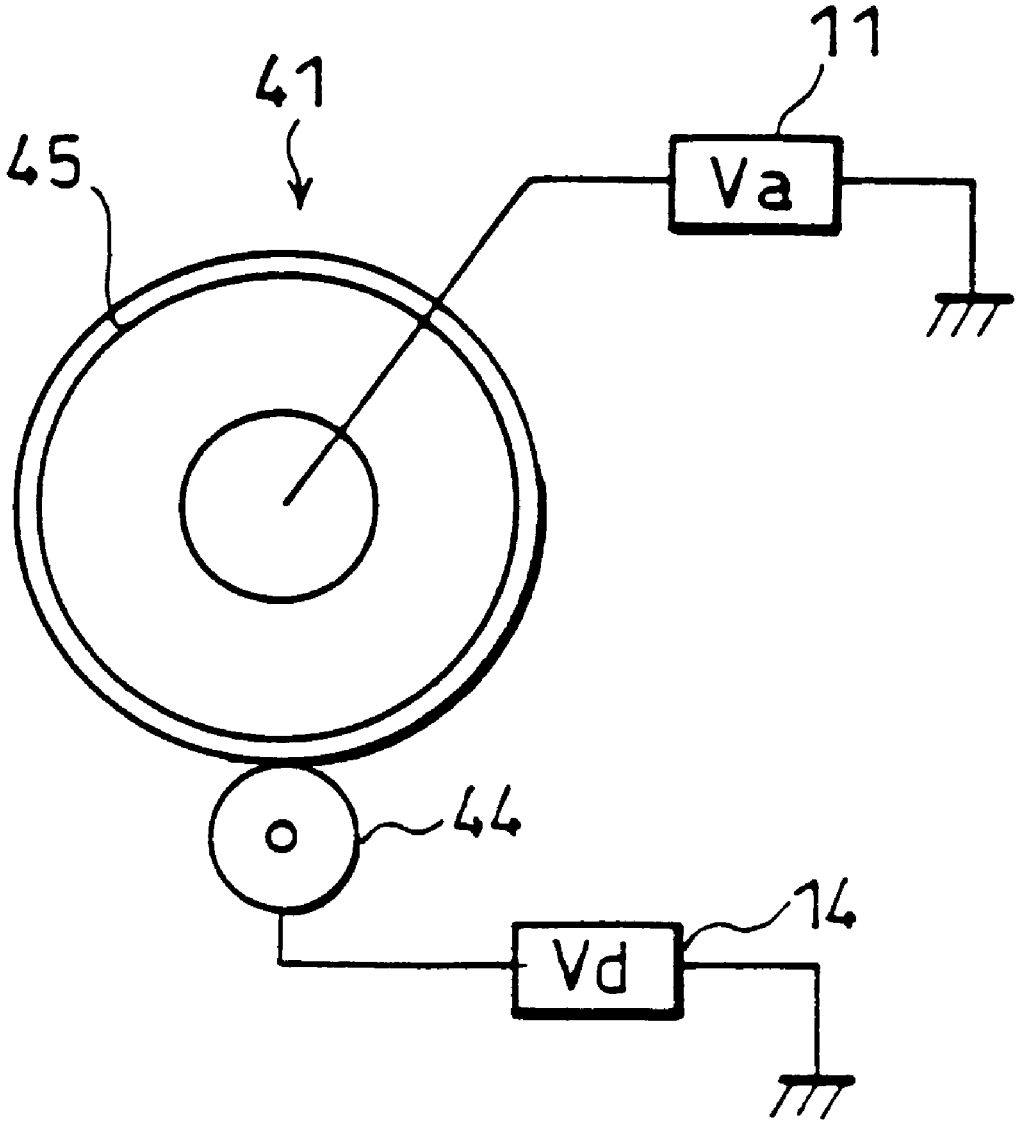
FIG. 19 is a drawing that shows a structure in which a rotating member of a contact-separating type is used as the reset member provided in the developing device of the present invention.

Furthermore, also in the case of the application of a conductive sheet to the reset member 44, the problem of non-uniformity due to a voltage drop occurs in the same manner as the above-mentioned blade 43 made of the conductive sheet; however, this problem can be solved by making the width of the electrode 44*a* (conductor electrode) of the reset member 44 longer than the image effective width as illustrated in FIG. 18.

[Embodiment 5]

Figure 7B:
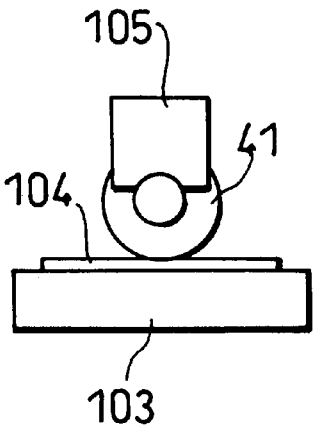
FIG. 7(*a*) is an explanatory drawing that shows a device for measuring the still resistivity of a developing roller that is provided in the developing device of the present invention.
Figure 7A:
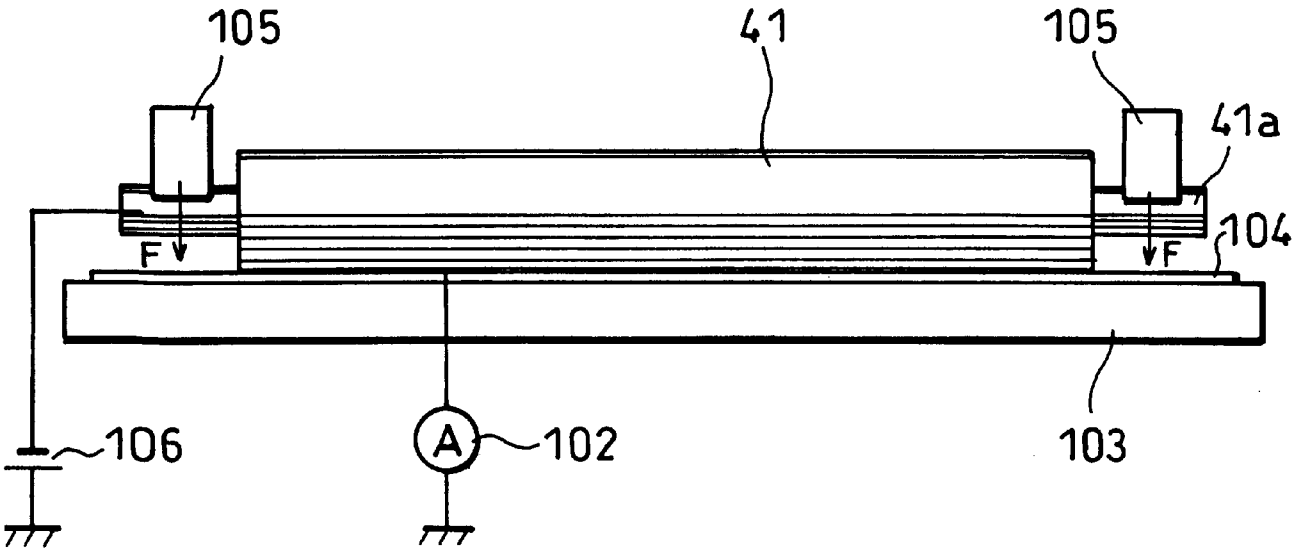
Figure 8:
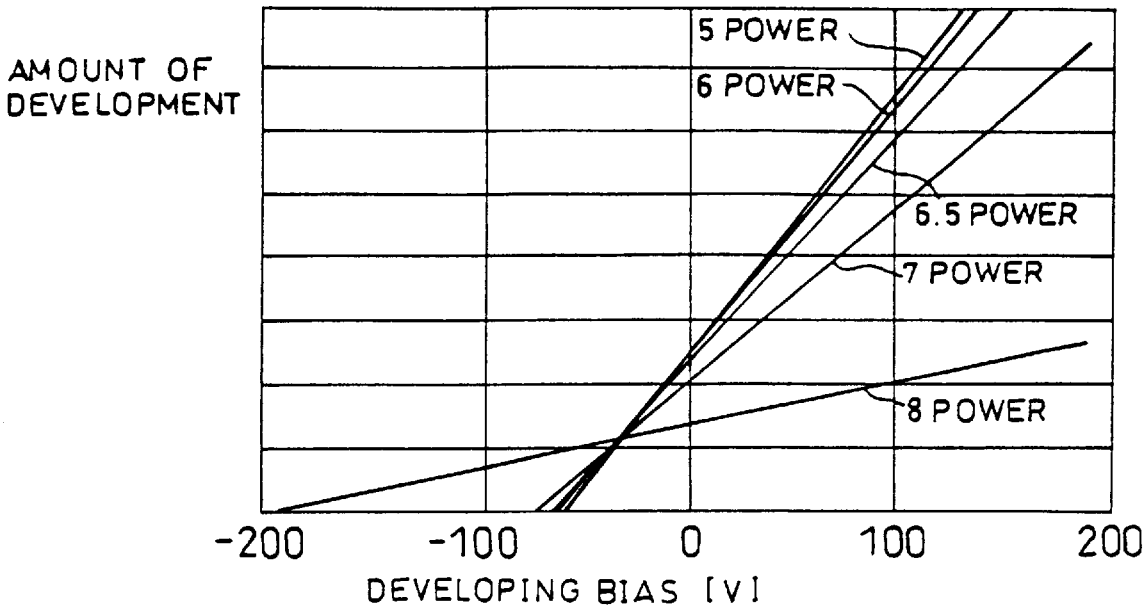
FIG. 8 is a graph that shows the relationship between the resistivity of the developing roller and its developing characteristic with respect to the developing device of the present invention.

Referring to FIGS. 7 and 8, the following description will discuss still another embodiment of the present invention. For convenience of explanation, those of the members described in embodiment 1 are indicated by the same reference numerals and the description thereof is omitted.

In the present embodiment, an explanation will be given of the value of resistivity of the developing roller 41 used in the developing device 4 of the present invention.

As illustrated in FIG. 7, in an abbreviated device for measuring the value of resistivity of the developing roller 41, the developing roller 41 is placed on a metal detection electrode 104 installed on an insulating flat plate 103, and a load F is applied via blocks 105 onto both of the ends of the shaft 41*a* of the developing roller 41. In this state, a constant voltage is supplied to the shaft 41*a* of the developing roller 41 from a power supply 106, and a current flowing through the detection electrode 104 is measured by an ampere meter 102. Thus, it is possible to measure the value of resistivity of an electrical resistance (Rb) in the developing roller 41 in a contact state based upon the voltage supplied and the measured current flow.

At this time, in the case of the existence of non-uniformity in the value of resistivity, the average value of measured values obtained at several points in the circumferential direction is defined as the central value of the value of resistivity of the developing roller 41. For this reason, after a measurement has been made in the state shown in FIG. 7, further measurements are made under the same conditions with the developing roller 41 rotated with a predetermined angle.

With respect to two kinds of rollers (A, B) of the electron-transfer type having a developing roller resistance layer in which carbon black is dispersed in a urethane resin and one kind of roller (C) of the ion conductive type having a developing roller resistance layer in which a urethane resin is used as its base, values of resistivity were measured by using the above-mentioned measuring device, and the average value of the values of resistivity for each roller is shown in Table 3. With respect to the values of resistivity, the current value at the time of application of a voltage of 10 V was measured by an R6871E made by Advantest Co., Ltd., and conversion was made thereon.

TABLE 3

| Developing Roller | Average Value of Resistivity [MΩ] |
|---|---|
| A | 2.13 |
| B | 0.27 |
| C | 12.3 |

In this case, the outer diameter of the developing roller was ϕ34, the thickness Dd of the resistance layer was 8 mm, the length in the axis direction was 320 mm, and the width of a nip section, formed at the time of a force F of 1 kg, was approximately 1.5 mm.

In the case when a developing roller having an average value of resistivity of not more than 10 MΩ was used, it was confirmed through experiments that the occurrence of an over-current increased in number, failing to provide a developing roller for practical use.

When the developing roller C was used to develop a half-tone image with its entire surface colored gray, a phenomenon arose in which the image density became thinner due to a high resistivity. This is because a voltage drop occurred in the semiconductive layer 46 of the developing roller 41 due to a developing current with the result that the effective developing bias dropped. This phenomenon is highly dependent on the value of resistivity of the semiconductive layer 46 of the developing roller 41, and although the threshold value slightly fluctuates due to the process rate, etc., it becomes significant when the value of resistivity exceeds $10^7\Omega$ in the developing device of the present invention, while it becomes virtually ignorable when the value of resistivity reduces to not more than $10^7\Omega$.

Moreover, FIG. 8 shows a developing characteristic in which the value of resistivity of the developing roller 41 is used as a parameter; and this indicates that the developing gamma changes to a great degree around a point exceeding $5\times10^6\Omega$. Taking into consideration fluctuations in the value of resistivity under the following environments, the upper limit of the value of resistivity of the developing roller which can maintain superior image quality is regarded as $5\times10^6\Omega$.

The values of resistivity as shown in Table 3 are values obtained under the standard measuring environments in accordance with JISZ-8703; however, for example, under high-temperature, high-moisture environments of 35° C. and 85% RH (Relative Humidity) or low-temperature, low-moisture environments of 5° C. and 20% RH, the value of resistivity tends to change, with the result that the developing characteristics tend to change greatly.

With respect to the semiconductive layer of the developing roller used in the developing device of the present invention, urethane resins are preferably used as the material thereof; however, as a result of measurements of the moisture absorption rate and the value of resistivity based upon method JISK-7209A, it is found that in the case of a urethane base member having a moisture absorption rate of 2 to 5%, the value of resistivity varies by one digit or two digits between high temperature, high moisture environments and low temperature, low moisture environments. In contrast, in the case of a urethane base member having a moisture absorption rate of 0.5 to 1%, the value of resistivity only varies by 0.5 to one digit, and it is less susceptible to fluctuations in the amount of developing due to the variations in the value of resistivity, and makes it possible to maintain good image quality.

[Embodiment 6]

Figure 13:
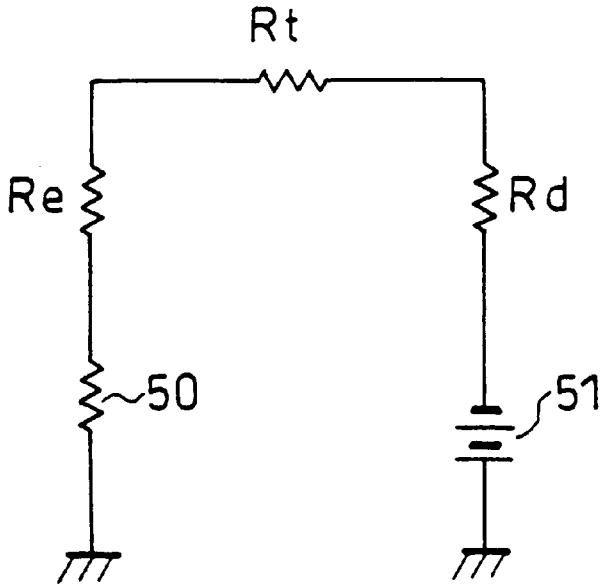
FIG. 13 is a circuit diagram that shows an equivalent circuit of the reset section shown in FIG. 12.

Referring to FIGS. 12 and 13, the following description will discuss the other embodiment of the present invention. For convenience of explanation, those of the members described in embodiment 1 are indicated by the same reference numerals and the description thereof is omitted.

In the above-mentioned embodiments, the value of resistivity of the toner layer 45 was regulated in order to provide a method for preventing an over-current that occurs in the case of the application of a developing roller 41 having a low electrical resistance. Moreover, any over-current was prevented by regulating the thickness of the toner layer so as to provide a good developing process. Furthermore, any over-current was also prevented by regulating the bias voltages to be supplied through various members that contact the developing roller 41 as well as the differences between the bias voltages.

However, the toner layer might be impaired due to an unexpected reason such as foreign matter included into the developing device, and this might cause an over-current. In order to solve this problem, the developing device 4 of the present embodiment is provided with an over-current protective function which will be described below.

As illustrated in FIG. 12, an arrangement is made so that a bias voltage (Vd) is supplied from the power-supply circuit 14 to the reset member 44 through an over-current protective resistor 50. In this case, it is very important to properly set the value of resistivity of the over-current protective resistor 50. For this reason, in order to explain the value of resistivity of the resistor 50, an electrically equivalent circuit of the circuit shown in FIG. 12 is shown in FIG. 13.

In the above-mentioned equivalent circuit, a voltage source 51, which represents an electric potential difference between the developing bias voltage Va supplied to the developing roller 41 and the bias voltage Vd supplied to the reset member 44, a semiconductive layer resistor Rd of the developing roller 41, a toner layer resistor Rt, a resistor Re of the reset member 44 and a protective resistor 50 are connected in series with one another.

In this case, the value of resistivity Rd of the developing roller 41 and the value of resistivity Re of the reset member 44 are set so as to be sufficiently lower than the value of resistivity Rt of the toner layer, and most of the bias voltage 51 to be supplied is normally applied to the toner layer 45, with the result that the value of a current flowing therethrough is minute. However, in the case when the toner layer is impaired and the value of resistivity Rt of the toner layer becomes apparently low, if no over-current protective resistor 50 is provided, an over-current flows since the entire resistance is low, thereby causing toner fusion and damages to the developing roller 41 and the reset member 44.

As illustrated in FIG. 12 (see the equivalent circuit of FIG. 13), with the arrangement in which the series protective resistor 50 is inserted, even in the case when the apparent value of resistivity of the resistor Rt of the toner layer becomes low, if the protective resistor 50 is set to be sufficiently greater than the resistor Rd of the developing roller 41 and the resistor Rc of the reset member 44, most of a voltage 51 applied to the respective members is supplied to the protective resistor 50 so that it becomes possible to prevent an over-current.

Therefore, when an attempt is made to make the over-current as small as possible, the value of resistivity of the protective resistor 50 is set as great as possible. However, if the value of resistivity of the protective resistor 50 is too great, a voltage that is supplied by the toner layer 45 and the protective resistor 50 in a normal state tends to be divided, with the result that the voltage applied to the toner layer 45 becomes smaller due to a voltage drop caused by the protective resistor 50. In this state, the bias voltage (Vd) is no longer applied to the reset member 44 in a manner as originally expected. For this reason, the upper limit of the value of resistivity of the protective resistor 50 has to be regulated. The following description will discuss an appropriate value on the upper limit of the value of resistivity of the over-current protective resistor 50.

In FIG. 12, an explanation is given of a construction in which the protective resistor 50 is only installed between the reset member 44 and the power-supply circuit 14; and the same protective resistor as the resistor 50 may be inserted between the supply roller 42 and the power-supply circuit 12 as well as between the developed-larger regulating member 43 and the power-supply circuit 13, if necessary, as shown in FIG. 12A.

Supposing that, on the photoconductive member 1 after a developing process, the amount of toner adhesion is m/a [kg/m$^2$], the toner specific charge is q/m [C/kg], the effective image width is l [m] and the peripheral velocity of the photoconductive member is v [m/sec], a developing current Id (A), generated by the charged toner being transferred from the developing roller 41 to the photoconductive member 1, is calculated from the following equation (7).

$$Id=q/m\times m/a\times l\times v \quad (7)$$

For example, supposing that, on the photoconductive member after a full solid-black developing process, the amount of adhesion of toner is 1.0 mg/cm$^2$, the toner specific charge is −20 $\mu$C/g, the effective image width is 300 mm and the peripheral velocity of the photoconductive member 1 is 190 mm/sec, the absolute value of the developing current is 11. 4 $\mu$A based upon the above-mentioned equation (7). This current value at the time of the full solid-black developing process forms a maximum value in the developing current.

The developing current Id is generated by the toner transfer at the developing section (the area at which the developing roller 41 and the photoconductive member 1 come into contact with each other); and this is also true for the supply roller 42, the blade 43 and the reset member 44 that come into contact with the developing roller 41.

The voltage drop Vr of the protective resistor 50, etc. due to the toner transfer current Ir is found from the following equation (8) based upon the value of resistivity of Rr of the protective resistor 50.

$$Vr=Ir\times Rr \quad (8)$$

Unless the voltage drop Vr is sufficiently small with respect to the bias voltage to be supplied, the bias effect is reduced since the voltage to be actually applied to the toner layer 45 becomes smaller. Therefore, the upper limit value (Rr) of the protective resistor 50, etc., is determined by a degree to which the voltage drop due to the toner transfer current is permitted in a regular state. Moreover, the lower limit value (Rr) of the respective protective resistors 50 is determined by a degree to which the over-current at the time of an abnormal event is permitted.

As a result of tests using various toners, it is experimentally confirmed that the value of toner specific charge for practical use is in the range of −5 to −30 $\mu$C/g, and more preferably, −10 to −20 $\mu$C/g, in the case of negatively chargeable toners. The amount of toner adhesion on the photoconductive member 1 required for a solid black copy is approximately 1.0 mg/cm$^2$, although this value slightly changes depending on the masking property of toners. Since the effective image width l [m] and the peripheral velocity v [m/sec] of the photoconductive member 1 are designing variables, the maximum transfer current Imax [$\mu$A], assumed for practical use, is represented by the following equation (9) after substitution of −30 $\mu$C for the specific charge and 1.0 mg/cm$^2$ for the amount of adhesion in equation (7).

$$Imax=300\times l\times v \quad (9)$$

Then, supposing that the upper limit of the permissible value of the over-current which would not cause any toner fusion or any damage to parts is n times the above-mentioned maximum transfer current, the lower limit value Rmin (MΩ) of the protective resistor 50 is represented as follows based upon equations 8 and 9.

$$Rmin=V/(300\times n\times l\times v) \quad (10)$$

In the above-mentioned equation (10), "V" represents a difference between a bias voltage supplied to the developing roller 41 and a surface electric potential of the photoconductive member 1 in contact with the developing roller 41 as shown in FIG. 13.

Here, with respect to the reset member 44, since hardly any toner remains on the developing roller 41 after a solid black copying process, the toner layer 45 hardly maintains a voltage, with the result that an over-current tends to flow. Although this over-current flows through the inside of the toner layer, some of this over-current also directly flows between the developing roller 41 and the reset member; therefore, the upper limit of the permissible value is slightly raised as compared with the supply roller 42 and the blade 43. Here, several protective values of resistivity were selected based upon equation (10), and actual developing tests were carried out on 10000 to 50000 sample copies. The results show that by setting n=5 in the case of the supply roller 42 and the blade 43 as well as setting n=10 in the case of the reset member 44, it becomes possible to solve problems, such as degradation in the developing process, caused by an over-current.

Therefore, the minimum values Rmin of over-current protective resistors to be inserted in the reset member 44, the supply roller 42 and the blade 43 are found by substituting "5" or "10" for "n" in the above-mentioned equation (10). Here, "V" in equation (10) represents a difference between the developing bias voltage (Va) and the reset bias voltage (Vd) in the reset member 44, a difference between the developing bias voltage and the supply bias voltage (Vc) in the supply roller 42, and a difference between the developing bias voltage and the regulating bias voltage (Vb) in the blade 43.

In other words, the minimum value of each of the over-current protective resistors R4, R3 and R2 that are inserted in the reset member 44, the supply roller 42 and the blade 43 is found from the following equations:

$$R4min=|Vd-Va=/(3000\times v\times l)$$

$$R3min=|Vb-Va=/(1500\times v\times l)$$

$$R2min=|Vc-Va=/(1500\times v\times l)$$

Various experiments were carried out using toners having the above-mentioned characteristics in the specific charge, the amount of toner adhesion, the film thickness, etc., while voltages to be supplied to the respective members were varied, and the results show that, with respect to the electric potential difference to be imposed on the toner layer, at least not less than 40 V is required. In this case, it is necessary to preliminarily supply a bias voltage large enough to deal with a voltage drop in the protective resistor section. In the case of a set electric potential difference of 40 V, supposing that the toner layer 45 has a breakdown voltage of approximately 400 V, a maximum 10 hold of allowance in the voltage against the breakdown of the toner layer 45 is obtained, and the permissible voltage drop in the protective resistor section is 360 V. In this manner, it becomes possible to widen the range of the protective resistor. Therefore, even in the event of an abrupt non-uniformity in the toner layer, it is possible to prevent a resulting over-current, and consequently to carry out a preferable developing operation.

Moreover, as explained in the above-mentioned equation (9), the maximum value of the transfer current in the toner layer was found based on the fact that the maximum value of the toner specific charge for practical use is 30 $\mu$C/g and that the amount of toner adhesion on the photoconductive member 1 required for a solid black copy is approximately 1.0 mg/cm$^2$. However, the supply roller 42 has functions by which toner on the surface of the developing roller 41 is removed after a developing process and toner inside the developing vessel 40 is charged and applied onto the developing roller 41. For this reason, the removing mechanism of toner from the developing roller 41 after a developing process requires a reversed current, with the result that the maximum current at the developing position becomes smaller than the maximum developing current. The results of actual measurements with respect to the current flowing through the supply roller 42 show that it is not more than ⅕ of the maximum developing current. Therefore, the upper limit value R2max (MΩ) of the protective resistor in the supply roller 42 is defined by the following equation (11) based upon equations (8) and (9).

$$R2max=6/(l\times v) \quad (11)$$

where V=360 V.

The following description will discuss the blade 43. Since toner has preliminarily been applied to the surface of the developing roller 41 by the supply roller 42, the blade 43 is hardly subjected to toner transfer; therefore, it is considered to be mostly subjected to the toner charging current. Therefore, its maximum current is smaller than the maximum developing current in the developing section. The results of actual measurements with respect to the current flowing through the blade 43 show that it is not more than ⅓ of the maximum developing current.

Moreover, after a developing process for a full white copy, virtually the same amount of toner as that prior to the developing process remains on the developing roller 41. When an attempt is made so as to electrically remove all the toner by using the reset member 44, the maximum current Imax, shown in equation (9), flows. However, in an actual operation, the toner refreshing process on the developing roller 41 is carried out more effectively in combination with the mechanical removing operation of the supply roller 42. For this reason, the removing bias voltage is set lower so that the amount of toner removal at the reset position does not reach 100%. With this arrangement, the static eliminating current becomes smaller than the above-mentioned Imax. Moreover, in the case when the reset member 44 is made of a fix member such as a sheet, removed toner is not transported to the developing vessel 40 effectively, with the result that the static eliminating current becomes smaller. The results of measurements on the current flowing through the reset member 44 after a developing process for a full white copy show that it is not more than ⅓ of the maximum developing current Imax.

Therefore, the upper limit value Rmax (Ω) of the protective resistor in the blade 43 (developer-layer regulating member) and the reset member 44 is defined by the following equation (12) based upon equations (8) and (9).

$$R3max=R4max=3.6/(l\times v) \quad (12)$$

From the above-mentioned equation, the protective resistors R4, R2 and R3, which are inserted between the developing roller 41 and the power supply circuits 14, 12 and 13 that respectively apply bias voltages to the reset member 44, the supply roller 42 and the blade 43, have respective values represented as follows:

$$|Vc-Va|/(1500\times v\times l)<R2<6/(l\times v)$$

$$|Vb-Va|/(1500\times v\times l)<R3<3.6/(l\times v)$$

$$|Vd-Va|/(3000\times v\times l)<R4<3.6/(l\times v)$$

It is well known in the art that an over-current occurring between the developing roller 41 and the photoconductive member 1 is prevented by inserting a protective resistor as described above between the developing roller 41 and the power supply circuit 11 that supplies a developing bias voltage. In this case, however, the following side effects occur.

For example, the developing current fluctuates due to fluctuations in the amount of development caused by the black-and-white ratio of an image. Consequently, the amount of a voltage drop in the developing roller 41 section is varied by the black-and-white ratio. This results in conspicuous density irregularities due to the black-and-white ratio particularly in half-tone images. In order to solve this problem, the developing device 4 of the present embodiment adopts a developing roller 41 with a low resistivity, and inserts a resistor 50 between the reset member 44 and the power supply circuit 14 as illustrated in FIG. 12, without inserting a resistor between the developing roller 41 and the power supply circuit 11. Moreover, after experimental studies made on the maximum electric potential difference applied onto the toner layer 45 in the developing section, it is confirmed that setting of not more 400 V makes it possible to avoid the possibility of any over-current against the photoconductive member 1.

Therefore, in the developing device 4 of the present embodiment, as illustrated in FIG. 12A, the protective resistors are inserted between the reset member 44, the supply roller 42 and the blade 43 and the power supply circuits 14, 12 and 13 for supplying voltages to the respective members; thus, it becomes possible to prevent any over-current even if the above-mentioned electric potential difference is increased, to widen the range of setting of the protective resistors, to eliminate the occurrence of an over-current, and consequently to provide a superior developing process.

Moreover, in the present invention, without inserting a protective resistor between the developing roller 41 and the power supply circuit 11, the developing bias voltage (Va) is supplied so that the electric potential difference at the developing section that contacts the photoconductive member 1 is set at not more than 400 V; this makes it possible to prevent any over-current, and to achieve a stable developing process.

As described above, the developing device of the present invention, which develops an electrostatic latent image on the electrostatic-latent image bearing body (photoconductive member 1), is provided with a developer-bearing body (developing roller 41) which bears one-component developer (toner) on its surface and develops the electrostatic latent image by contacting the electrostatic-latent-image bearing body, a developer-supplying member (supply roller 42) for supplying developer to the developer-bearing body, and a developer-layer regulating member (blade 43) which contacts the developer-bearing body so as to regulate the layer thickness of the developer that has been supplied by the developer-supplying member, and supposing that the volume-average particle size of the developer is Dbk, the developer at this time being maintained on the developer-bearing body as a layer that has been supplied by the developer-supplying member and again formed so as to have a predetermined thickness by the developer-layer regulating member after the developer-bearing body, on which the developer was formed as a layer having a predetermined thickness, carried out a colored-image developing process (black-image developing process), and supposing that the volume-average particle size of the developer is Dwt, the developer at this time being maintained on the developer-bearing body as a layer that has been supplied by the developer-supplying member and again formed so as have a predetermined thickness by the developer-layer regulating member after the developer-bearing body, on which the developer was formed as a layer having a predetermined thickness, carried out a non-color-image developing process (white-image developing process), an inequality, Dwt/Dbk>0.8 is satisfied.

In the above-mentioned arrangement, by controlling and limiting the difference between the volume-average particle size Dwt of the developer at a white-image developing portion and the volume-average particle size Dbt of a black-image developing portion to the range indicated by the above-mentioned inequality, it is possible to maintain the change in the average quantity of specific charge that depends on image patterns within a constant value range; therefore, it becomes possible to prevent the generation of developing image ghosts, and consequently to provide a developing device which can carry out a desired developing process.

In the developing device having the above-mentioned arrangement, for example, by using a one-component developer having a CV value [%] of not more than 25%, the CV value being defined as CV=100×(standard deviation/average value) so as to represent the distribution of the volume-average particle size, it is possible to control and limit the difference between the volume-average particle size Dwt of the developer at a white-image developing portion and the volume-average particle size Dbt of a black-image developing portion to the range indicated by the above-mentioned inequality.

Moreover, in the above-mentioned arrangement, the developing device is preferably arranged so that supposing that the film thickness of the one-component developer maintained on the developer-bearing body is T [$\mu$m] and that the volume-average particle size is D [$\mu$m], $T<3\times D$ is satisfied.

In other words, even in the case when a one-component developer having the CV value of 25% is used, if the amount of adhesion of the one-component developer to the developer-bearing body is great, more specifically, if the thickness of the developer layer exceeds three times the average-volume particle size, the particle size fluctuation in the developer tends to take place in such a level that developing image ghosts might occur. Therefore, by arranging the developing device of the present invention so as to satisfy the above-mentioned conditions, it becomes possible to prevent the occurrence of developing image ghosts due to the fluctuation in the volume particle size of the developer more positively.

Furthermore, in another arrangement by which the difference between the volume-average particle size Dwt of the developer at a white-image developing portion and the volume-average particle size Dbt of a black-image developing portion is controlled and limited to the range Dwt/Dbk>0.8, a reset member 44, which contacts the developer-bearing body after the developer-bearing body and the electrostatic-latent-image bearing body came into contact with each other, may be adopted.

In this arrangement, the developing device of the present invention is preferably designed so that supposing that a voltage applied to the developer-bearing body (developing roller 41) is Va [V] and a voltage applied to the reset member 44 is Vd [V], the voltages are preferably applied in a manner so as to make the sign of Va−Vd identical to the charging polarity of the developer.

In the above-mentioned arrangement, by allowing the reset member 44 to contact the developer-bearing body (photoconductive member 1) so as to apply a voltage for attracting the charged developer (toner) toward the reset member side, it is possible to remove and static-eliminate developer remaining on the developing roller 41 after a white-image developing process and consequently to provide a state identical to the state after a black-image developing process. This makes it possible to minimize the difference between the toner volume-average particle size after the black-image developing process and the toner volume-average particle size after the white-image developing process, and consequently prevent the occurrence of developing image ghosts.

Here, supposing that a voltage applied to the developer-bearing body (developing roller 41) is Va [V] and a voltage applied to the developer-layer regulating member (blade 43) is Vb [V], the voltages are preferably applied in a manner so as to make the sign of Va−Vb reversed to the charging polarity of the developer.

In the above-mentioned arrangement, by allowing the blade 43 to contact the developing roller 41 so as to apply a voltage for attracting the charged toner toward the developing roller 41, it is possible to minimize dispersions in the thickness of the toner layer and the quantity of specific charge, and consequently to reduce density irregularities in half-tone images; thus, it becomes possible to provide better quality in developed images in combination with the above-mentioned effects for preventing developing image ghosts.

Moreover, supposing that a voltage applied to the developer-bearing body (developing roller 41) is Va [V] and a voltage applied to the supply roller 42 is Vc [V], the voltages are preferably applied in a manner so as to make the sign of Va−Vc reversed to the charging polarity of the toner.

In the above-mentioned arrangement, by allowing the supply roller 42 to contact the developing roller 41 so as to apply a voltage for attracting the charged toner toward the developing roller 41, it is possible to minimize dispersions in the thickness of the toner layer and the quantity of specific charge, and consequently to reduce density irregularities in half-tone images; thus, it becomes possible to provide better quality in developed images in combination with the above-mentioned effects for preventing developing image ghosts.

Here, the above-mentioned reset member may be provided as a rotating member of a contact-separating type (conductive roller) that is installed so as to contact the developer-bearing body.

When the reset member is formed by the rotating member of a contact-separating type such as a conductive roller, it becomes possible to achieve a developing device with longer service life.

Moreover, in the event of a surface electric potential changing phenomenon in the developer-bearing body (developing roller 41) at a position relating to the developer-supplying member (supply roller 42), the developer-layer regulating member (blade 43) or the reset member 44, degradation in the image quality tends to occur. Here, the developing device of the present invention also makes it possible to eliminate developing image ghosts due to fluctuations in the surface electric potential, for example, by providing the following arrangements.

More specifically, in each of the above-mentioned arrangements, the developer-bearing body (developing roller 41) is preferably constituted by a conductive shaft (rotary shaft 41*a*) and a flexible semiconductive layer 46 formed on the conductive shaft, and designed so that supposing that the resistivity at a position allowing the developer-bearing body to contact the electrostatic latent-image bearing body through the developer is Rd [Ω], $10^4<Rd<5\times10^6$ is satisfied.

Here, the semiconductive layer on the developer-bearing body is preferably made of a urethane resin having a moisture absorption rate of not more than 1%.

With the arrangement in which the urethane resin having a moisture absorption rate of not more than 1% is used as the semiconductive layer on the developing roller 41, it becomes possible to minimize fluctuations in the value of resistivity due to fluctuations in temperature and moisture, and also to prevent contamination to the electrostatic latent-image bearing body as well as effectively preventing degradation in the image quality.

Here, the members such as the reset member 44 and the supply roller 42 are preferably made of a low resistivity material so that the resistivity is set to not more than 10 kΩ at a portion thereof contacting the developing roller 41 through a metal material or the developer.

With the above-mentioned arrangement, since upper limits are provided in the values of resistivity in the members such as the reset member 44 and the supply roller 42, it is possible to prevent fluctuations in the surface electric potential due to accumulated charges on the surfaces of those members, and consequently to prevent degradation in the toner removing characteristic.

Moreover, in the above-mentioned arrangement, the reset member 44 or the developer-layer regulating member (blade 43) is preferably constituted by a thin plate member made of a low resistivity material, a conductor electrode (electrode 44*a*, electrode 43*a*) that is formed with a width virtually not less than the effective image width on the surface other than the contact portion with the toner layer 45 of the thin plate member and a voltage applying means (power supply 14, power supply 13) for applying a voltage to the conductor electrode.

With this arrangement, it becomes possible to prevent degradation in the image quality due to non-uniformity in the applied bias voltage in the axis direction at the reset section or the developer-layer regulating section, and consequently to ensure a superior developing operation.

The developing device is preferably designed so that supposing that a voltage applied to the developer-bearing body is Va [V] and a voltage applied to the reset member is Vd [V], and supposing that the one-component developer maintained on the electrostatic-latent-image bearing body has a layer thickness of T [$\mu$m], an inequality, $|Va-Vd| \leqq 20\times T$, is satisfied.

Moreover, the developing device is preferably designed so that supposing that a voltage applied to the developer-bearing body is Va [V] and a voltage applied to the developer-supplying member is Vc [V], and supposing that the one-component developer maintained on the electrostatic-latent-image bearing body has a layer thickness of T [$\mu$m], an inequality, $|Va-Vc| \leqq 20\times T$, is satisfied.

In the same manner, the developing device is preferably designed so that supposing that a voltage applied to the developer-bearing body is Va [V] and a voltage applied to the developer-layer regulating member is Vb [V], and supposing that the one-component developer maintained on the electrostatic-latent-image bearing body has a layer thickness of T [$\mu$m], an inequality, $|Va-Vb| \leqq 20\times T$, is satisfied.

As described above, by setting the voltages to be supplied to the toner layer through the supply roller, the blade or the reset member which contacts the developing roller at not more than the above-mentioned value, 20×T[V], in accordance with the thickness T of the toner layer, it becomes possible to prevent degradation in the developing operation due to a dielectric breakdown of the toner layer.

Moreover, the developing device of the present invention is preferably designed so as to include a voltage-applying means for applying a voltage to the reset member and an over-current protecting resistor connected between the reset member and the voltage-applying means, in which, supposing that a voltage applied to the developer-bearing body is Va [V] and a voltage applied to the reset member is Vd [V] and supposing that the peripheral velocity of the electrostatic-latent-image bearing body is v [m/s] and the effective width of the developer-bearing body is l [m], the resistivity R4 [MΩ] of the resistor satisfies an inequality, $|Vd-Va|/(3000\times v\times l)<R4<3.6/(l\times v)$.

Furthermore, the developing device of the present invention is preferably designed so as to include a voltage-applying means for applying a voltage to the developer-supplying member and an over-current protecting resistor connected between the developer-supplying member and the voltage-applying means, in which, supposing that a voltage applied to the developer-bearing body is Va [V] and a voltage applied to the developer-supplying member is Vc [V] and supposing that the peripheral velocity of the electrostatic-latent-image bearing body is v [m/s] and the effective width of the developer-bearing body is l [m], the resistivity R2 [MΩ] of the resistor satisfies an inequality, $|Vc-Va|/(1500\times v\times l)<R2<6/(l\times v)$.

The developing device of the present invention is also preferably designed so as to include a voltage-applying means for applying a voltage to the developer-layer regulating member and an over-current protecting resistor (protective resistor 50) connected between the developer-layer regulating member and the voltage-applying means, in which, supposing that a voltage applied to the developer-bearing body is Va [V] and a voltage applied to the developer-layer regulating member is Vb [V] and supposing that the peripheral velocity of the electrostatic-latent-image bearing body is v [m/s] and the effective width of the developer-bearing body is l [m], the resistivity R3 [MΩ] of the resistor satisfies an inequality, $|Vb-Va|/(1500\times v\times l)<R3<3.6/(l\times v)$.

With the above-mentioned arrangement, in addition to the above-mentioned regulations in the values of resistivity, since the protective resistors are inserted in the respective members and since the upper limits of the applied voltages are set, it becomes possible to prevent deterioration in the toner layer due to over-currents, and consequently also to prevent degradation in the image quality.

Moreover, in the arrangement of the developing device of the present invention, it is preferable to set the semiconductive layer of the developing roller so as to have a resistivity of not more than $10^7$ Ω.

Furthermore, in the respective arrangements of the above-mentioned developing device, supposing that the resistivity of the developer layer in a thin-film state formed on the developing roller 41 is Rt [Ω], it is preferable to set Rt [Ω] so as to satisfy the following inequality:

$$Rt \geqq 5\times 10^7$$

With the above-mentioned arrangement of the developing device, since the lower limit of the value of resistivity in the toner layer is regulated, it becomes possible to improve the safety against a dielectric breakdown of the toner layer and over-currents even when a bias voltage is applied to each of the members, and consequently to realize stable toner-layer forming and developing characteristics.

In the above-mentioned arrangement, since the lower limit is given to the resistivity of the developing roller 41, it becomes possible to overcome problems such as dielectric breakdown and over-currents between the developing roller 41 and the members in contact therewith.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A developing device for developing an electrostatic latent image on an electrostatic-latent-image bearing body comprising:

a developer-bearing body which bears a one-component developer on a surface thereof and develops the electrostatic latent image by contacting the electrostatic-latent-image bearing body;

a developer-supplying member for supplying developer to the developer-bearing body; and a developer-layer regulating member which contacts the developer-bearing body so as to regulate a layer thickness of the developer that has been supplied by the developer-supplying member, wherein supposing that the developer has a volume-average particle size represented by Dbk, the developer at this time being maintained on the developer-bearing body as a layer that has been supplied by the developer-supplying member and again formed so as to have a predetermined thickness by the developer-layer regulating member after the developer-bearing body, on which the developer was formed as a layer having a predetermined thickness, carried out a colored-image developing process, and supposing that the volume-average particle size of the developer is Dwt, the developer at this time being maintained on the developer-bearing body as a layer that has been supplied by the developer-supplying member and again formed so as to have a predetermined thickness by the developer-layer regulating member after the developer-bearing body, on which the developer was formed as a layer having a predetermined thickness, carried out a non-color-image developing process, an inequality, $Dwt/Dbk>0.8$ is satisfied.

2. The developing device as defined in claim 1, wherein said one-component developer has a CV value (%) of not more than 25%, the CV value being defined as CV=100× (standard deviation of volume particle sizes/average value of the volume particle sizes) so as to represent a distribution in volume-average particle sizes.

3. The developing device as defined in claim 2, wherein supposing that the one-component developer maintained on the developer-bearing body has a film thickness of T [$\mu$m] and a volume-average particle size of D [$\mu$m], $T<3\times D$ is satisfied.

4. The developing device as defined in claim 1, further comprising: a reset member which contacts the developer-bearing body, after the developer-bearing body and the electrostatic-latent-image bearing body came into contact with each other, so as to eliminate developer remaining on the developer-bearing body.

5. The developing device as defined in claim 4, wherein supposing that a voltage applied to the developer-bearing body is Va [V] and a voltage applied to the reset member is Vd [V], the voltages are applied in a manner so as to make the sign of Va−Vd identical to a charging polarity of the developer.

6. The developing device as defined in claim 5, wherein the reset member is made of a metal material.

7. The developing device as defined in claim 5, wherein the reset member is made of a low resistivity material so as to have a resistivity of not more than 10 kΩ at a portion thereof contacting the developer-bearing body through the developer.

8. The developing device as defined in claim 7, wherein said reset member comprises:

a thin plate member made of said low resistivity material;

a conductive electrode formed on a surface of the thin plate at a portion other than the portion contacting the developer-bearing body, said conductive electrode having a width not less than an effective image width; and a voltage-applying means for applying a voltage to said conductive electrode.

9. The developing device as defined in claim 4, wherein said reset member is a rotating member of a contact-separation type that is placed in contact with said developer-bearing body.

10. The developing device as defined in claim 4 wherein, supposing that a voltage applied to the developer-bearing body is Va [V] and a voltage applied to the reset member is Vd [V] and supposing that the one-component developer maintained on the electrostatic-latent-image bearing body has a layer thickness of T [$\mu$m], an inequality, $|Va-Vd|\leqq 20\times T$, is satisfied.

11. The developing device as defined in claim 4, further comprising:

a voltage-applying means for applying a voltage to said reset member; and an over-current protective resistor that is connected between said reset member and the voltage-applying means.

12. The developing device as defined in claim 11 wherein, supposing that a voltage applied to the developer-bearing body is Va [V] and a voltage applied to the reset member is Vd [V] and supposing that a peripheral velocity of the electrostatic-latent-image bearing body is v [m/s] and an effective width of the developer-bearing body is l [m], said resistor has a resistivity R4 [MΩ] that satisfies an inequality, $|Vd-Va|/3000\times v\times l)<R4<3.6/(l\times v)$.

13. The developing device as defined in claim 1 wherein, supposing that a voltage applied to the developer-bearing body is Va [V] and a voltage applied to the developer-supplying member is Vc [V] and supposing that the one-component developer maintained on the electrostatic-latent-image bearing body has a layer thickness of T [$\mu$m], an inequality, $|Va-Vc|\leqq 20\times T$, is satisfied.

14. The developing device as defined in claim 1 wherein, supposing that a voltage applied to the developer-bearing body is Va [V] and a voltage applied to the developer-layer regulating member is Vb [V] and supposing that the one-component developer maintained on the electrostatic-latent-image bearing body has a layer thickness of T [$\mu$m], an inequality, $|Va-Vb|\leqq 20\times T$, is satisfied.

15. The developing device as defined in claim 1, further comprising:

a voltage-applying means for applying a voltage to said developer-supplying member; and an over-current protective resistor that is connected between said developer-supplying member and the voltage-applying means.

16. The developing device as defined in claim 15 wherein, supposing that a voltage applied to the developer-bearing body is Va [V] and a voltage applied to the developer-supplying member is Vc [V] and supposing that a peripheral velocity of the electrostatic-latent-image bearing body is v [m/s] and an effective width of the developer-bearing body is l [m], said resistor has a resistivity R2 [MΩ] that satisfies an inequality, $|Vc|Va|/(1500\times v\times l)<R2<6/(l\times v)$.

17. The developing device as defined in claim 1, further comprising:

a voltage-applying means for applying a voltage to said developer-layer regulating member; and an over-current protective resistor that is connected between said developer-layer regulating member and the voltage-applying means.

18. The developing device as defined in claim 17 wherein, supposing that a voltage applied to the developer-bearing body is Va [V] and a voltage applied to the developer-layer regulating member is Vb [V] and supposing that a peripheral velocity of the electrostatic-latent-image bearing body is v [m/s] and an effective width of the developer-bearing body is l [m], said resistor has a resistivity R3 [MΩ] that satisfies an inequality, $|Vb-Va|/(1500\times v\times l)<R3<3.6/(l\times v)$.

19. The developing device as defined in claim 1, wherein:

the developer-bearing body includes a conductive shaft and a flexible semiconductive layer formed on the conductive shaft, and supposing that a resistivity at a position allowing the developer-bearing body to contact the electrostatic latent-image bearing body through the developer is Rd [Ω], $10^4<Rd<5\times10^6$ is satisfied.

20. The developing device as defined in claim 19, wherein said semiconductive layer on the developer-bearing body is made of a urethane resin having a moisture absorption rate of not more than 1%.

21. The developing device as defined in claim 1 wherein the developer layer in a thin-film state formed on the developer-bearing body has a resistivity of Rt [Ω] that satisfies $Rt>5\times10^7$.

22. The developing device as defined in claim 1 wherein, supposing that a voltage applied to the developer-bearing body is Va [V] and a voltage applied to said developer-layer regulating member is Vb [V], Va−Vb has a sign that is reversed to a charging polarity of the developer.

23. The developing device as defined in claim 1 wherein, supposing that a voltage applied to the developer-bearing body is Va [V] and a voltage applied to the developer-supplying member is Vc [V], Va−Vc has a sign that is reversed to a charging polarity of the developer.

* * * * *